US010211039B2

(12) United States Patent
Verenchikov et al.

(10) Patent No.: US 10,211,039 B2
(45) Date of Patent: Feb. 19, 2019

(54) MULTI-REFLECTING MASS SPECTROMETER WITH HIGH THROUGHPUT

(71) Applicant: LECO Corporation, St. Joseph, MI (US)

(72) Inventors: Anatoly N. Verenchikov, St. Petersburg (RU); Viatcheslav Artaev, St. Joseph, MI (US)

(73) Assignee: LECO Corporation, St. Joseph, MI (US)

( * ) Notice: Subject to any disclaimer, the term of this patent is extended or adjusted under 35 U.S.C. 154(b) by 0 days.

(21) Appl. No.: 15/884,154

(22) Filed: Jan. 30, 2018

(65) Prior Publication Data

US 2018/0174816 A1 Jun. 21, 2018

Related U.S. Application Data

(62) Division of application No. 14/786,714, filed as application No. PCT/US2014/035104 on Apr. 23, 2014, now Pat. No. 9,881,780.

(Continued)

(51) Int. Cl.
*H01J 49/40* (2006.01)
*H01J 49/06* (2006.01)

(Continued)

(52) U.S. Cl.
CPC ..... *H01J 49/406* (2013.01); *H01J 49/004* (2013.01); *H01J 49/062* (2013.01); *H01J 49/4245* (2013.01)

(58) Field of Classification Search
USPC ..... 250/292, 287, 281
See application file for complete search history.

(56) References Cited

U.S. PATENT DOCUMENTS 5,811,820 A 9/1998 Kirchner et al.
6,833,544 B1 12/2004 Campbell et al.

(Continued)

FOREIGN PATENT DOCUMENTS

CN 101320016 A 12/2008
CN 101364519 A 2/2009

(Continued)

OTHER PUBLICATIONS

International Search Report dated Mar. 10, 2015, relating to International Application No. PCT/US2014/035104.

(Continued)

*Primary Examiner* — Kiet T Nguyen
(74) *Attorney, Agent, or Firm* — Honigman LLP

(57) ABSTRACT

Method and embodiments are provided for tandem mass spectrometer designed for extremely large charge throughput up to 1E+10 ion/sec. In one operation mode, the initial ion flow with wide m/z range is time separated in a trap array. The array ejects ions with a narrower momentarily m/z range. Ion flow is collected and confined in a wide bore ion channel at a limited time spread. The ion flow with narrow m/z range is then analyzed in a multi-reflecting TOF at frequent and time-encoded operation of the orthogonal accelerator, thus forming multiple non overlapping spectral segments. In another mode, time separated ions are subjected to fragmentation for comprehensive, all-mass MS-MS analysis. The momentarily ion flow at MR-TOF entrance is characterized by lower spectral population which allows efficient decoding of overlapping spectra. Those modes are combined with conventional spectrometer operation to improve the dynamic range. To provide practical solution, there are proposed multiple novel components comprising trap arrays, wide bore confining channels, resistive multipole, so as long life TOF detector.

2 Claims, 11 Drawing Sheets

Related U.S. Application Data

(60) Provisional application No. 61/814,923, filed on Apr. 23, 2013.

(51) Int. Cl.
*H01J 49/00* (2006.01)
*H01J 49/42* (2006.01)

(56) References Cited

U.S. PATENT DOCUMENTS

| | | | | |
|---|---|---|---|---|
| 7,888,635 | B2 * | 2/2011 | Belov | H01J 49/4235 250/281 |
| 2008/0067342 | A1 | 3/2008 | Ding | |
| 2008/0185511 | A1 | 8/2008 | Senko | |
| 2009/0294655 | A1 | 12/2009 | Ding et al. | |
| 2013/0048852 | A1 | 2/2013 | Verenchikov | |
| 2014/0061457 | A1 * | 3/2014 | Berdnikov | H01J 49/0095 250/281 |
| 2015/0194296 | A1 | 7/2015 | Verenchikov et al. | |
| 2015/0233866 | A1 | 8/2015 | Verenchikov | |

FOREIGN PATENT DOCUMENTS

| | | | |
|---|---|---|---|
| CN | 101369510 | A | 2/2009 |
| DE | 112010005323 | T5 | 1/2013 |
| GB | 2390935 | A | 1/2004 |
| JP | 2005251594 | A | 9/2005 |
| JP | 2009535759 | A | 10/2009 |
| JP | 2015521784 | A | 7/2015 |
| WO | WO-2011107836 | A1 | 9/2011 |
| WO | WO-20110135477 | A1 | 11/2011 |

OTHER PUBLICATIONS

Japanese Office Action for Application No. 2016-510753 dated Nov. 29, 2016 with English Translation thereof.
German Office Action for the related application No. 112014002092.3 dated Apr. 13, 2017 with its English translation thereof.
Non-Final Office Action dated Jun. 2, 2017, by the U.S. Patent and Trademark Office relating to U.S. Appl. No. 14/786,714.
Japanese office action for the related application No. 2017-216220 dated Oct. 17, 2018 with its English translation thereof.

* cited by examiner

MULTI-REFLECTING MASS SPECTROMETER WITH HIGH THROUGHPUT

This Application is a Division of application Ser. No. 14/786,714 filed on Oct. 23, 2015, which is a national stage of International Patent Application No. PCT/US2014/035104 filed on Apr. 23, 2014, which claims the benefit of U.S. Provisional Application 61/814,923 filed on Apr. 23, 2013, which is entirely incorporated herein by reference.

This disclosure relates to the field of mass spectroscopic analysis, multi-reflecting mass spectrometers, ion traps, and tandem mass spectrometers for comprehensive, all-mass MS-MS analysis.

BACKGROUND

MR-TOF with Frequent Pulsing

U.S. Pat. No. 5,017,780, incorporated herein by reference, discloses a multi-reflecting time-of-flight mass spectrometers with a folded ion path (MR-TOF). Ion confinement is improved with a set of periodic lenses. MR-TOF reaches resolving power in the range of 100,000. When combined with orthogonal accelerator (OA), the MR-TOF has low duty cycle, usually below 1%. When combined with a trap converter, the space charge of ion packets affect MR-TOF resolution, at number of ions per packet per shot being above 1E+3 ions. Accounting for a 1 ms flight time in MR-TOF, this corresponds to a generally maximal signal under 1E+6 per peak per second.

To improve both duty cycle and space charge throughput, WO2011107836, incorporated herein by reference, discloses an open trap electrostatic analyzer, wherein ion packets are no longer confined in the drift direction, so that any mass specie is presented by multiple signals corresponding to a span in number of ion reflections. The method solves the problem of OA duty cycle and the problem of space charge limitation within the MR-TOF analyzer. However, spectral decoding fails at ion fluxes above 1E+8 ions a second.

WO2011135477, incorporated herein by reference, discloses a method of encoded frequent pulsing (EFP) to solve the same problem in a generally more controlled manner and to allow an extremely rapid profile recording of any upfront separation, down to 10 μs time resolution. The spectral decoding step is well suitable for recording fragment spectra in tandem MS, since spectral population is under 0.1%. However, when EFP MR-TOF is applied as a single mass spectrometer, the spectral decoding does limit the dynamic range under 1E+4 due to densely populated chemical background.

Modern ion sources are capable of delivering up to 1E+10 ions/second (1.6 nA) into mass spectrometers. The spectral population before any decoding approaches 30-50% if accounting signal in 1E+5 dynamic range. The prior art EFP methods becomes not suitable to acquire huge ion fluxes in full dynamic range.

This disclosure proposes an improvement of EFP-MR-TOF by (a) using an upfront lossless and crude mass separation in time; gas dampening of the mass separated ion flow; frequent pulsing of an orthogonal accelerator at period between ejection pulses being much shorter than the flight time of heaviest ions in MR-TOF; and using a detector with an extended dynamic range and life-time to handle ion fluxes up to 1E+10 ion/sec. The lossless first cascade separator may be a trap array followed by wide bore ion transfer channel, or a trap array pulsed converter with a wide-open crude TOF separator followed by a soft dampening cell, primarily, surface induced dissociation (SID) cell, operating at low collision energy under 10-20 eV.

Comprehensive MS-MS (C-MS-MS)

For reliable and specific analyte identification, tandem mass spectrometers operate as follows: parent ions are selected in a first mass spectrometer and get fragmented in a fragmentation cell, such as collisional induced dissociation (OD) cell; then fragment ion spectra are recorded in a second mass spectrometer. Conventional tandem instruments, like quadrupole-TOF (Q-TOF), filter a narrow mass range while rejecting all others. When analyzing complex mixtures, sequential separation of multiple m/z ranges slows down the acquisition and affects sensitivity. In order to increase speed and sensitivity of MS-MS analysis, so-called "comprehensive", "parallel", or "all-mass" tandems have been described: Trap-TOF in U.S. Pat. No. 6,504,148 and WO01/15201, TOF-TOF in WO2004008481, and LT-TOF in U.S. Pat. No. 7,507,953, all incorporated herein by reference.

However, none of prior art comprehensive MS-MS is capable of solving the task of tandem MS improvement compared to filtering tandems, which defeats the purpose of parallel MS-MS. Multiple limitations do not allow operating with the entire ion flow up to 1E+10 ions/sec coming from ion sources. Thus, the gain of parallel analysis in the first MS is cancelled by ion losses at MS1 entrance and the overall sensitivity and speed (limited primarily by signal intensity for minor components) do not exceed those in conventional filtering Q-TOF.

Brief estimates are provided to support the statement. In Q-TOF the duty cycle of MS1 is 1% to provide standard resolution R1=100 of parent mass selection. The duty cycle of TOF is in the order of 10-20% at resolution of R2~50,000. Recent trends in MS-MS analysis demonstrate that such level of R2 gives substantial advantage in MS-MS data reliability, i.e. lower R2 should not be considered for MS-MS, which sets the lower limit for TOF period as 300 us. Thus the overall merits for comparison are: DC=0.1% and R=50.00 at incoming ion flow of 1E+10 ion/sec. In an exemplar MS-MS as described in U.S. Pat. No. 7,507,953, time required for recording fragment spectra of a single parent ion fraction is at least 1 ms (3 TOF spectra per parent mass fraction). To provide R1=100 of parent mass separation, the scan time is no less than 100 ms. Accounting space charge capacity of single linear ion trap N=3E+5 ion/cycle, the overall charge throughput is 3E+6 ions/sec. Accounting 1E+10 ion/sec incoming flow, the overall duty cycle of LT-TOF in U.S. Pat. No. 7,507,953 equals to 0.03% which is lower compared to above estimated Q-TOF tandem. Since the purpose and the task of parallel MS-MS are not solved, the tandem of U.S. Pat. No. 7,507,953 becomes no more than combination of prior known solutions: LT for extending space charge capacity, RF channel for transferring ion flow past the trap, TOF for parallel recording of all masses, and tandem of trap with TOF for parallel operation; while providing a novel component—RF channel for collecting ions past linear trap.

This disclosure proposes a solution for the task of comprehensive MS-MS analysis with the efficiency far exceeding one of filtering tandems, like Q-TOF. The same above proposed tandem (lossless mass separator and EFP MR-TOF) further comprises a fragmentation cell in-between the mass-spectrometric cascades. In case of trap array, the wide bore dampening transfer channel is followed by an RF converging channel, such as ion funnel, and the ions are introduced into a OD cell, e.g. made of resistive multipole for rapid ion transfer. In case of crude TOF separator, the SID cell is employed with delayed pulsed extraction.

The proposed MS-EFP-MRTOF and MS-CID/SID-EFP-MRTOF tandems would suffer the same problem (of defeating the purpose) if any of the tandem components fail handling ion flux above 1E+10 ions/sec at separation and 1E+9 ion/sec at detection. Apparently, neither prior art trap mass spectrometers, nor crude TOF separators, nor TOF detectors and data systems are capable of handling ion fluxes of 1E+9 to 1E+10 ions/sec. Novel instruments becomes practical only with introduction of multiple novel components in the present invention.

Parallel Mass Separators

Analytical quadrupole mass analyzers (Q-MS) operate as a mass filter passing through one m/z specie while removing all other species. To improve the duty cycle, ion trap mass spectrometers (ITMS) operate in cycles—ions of all m/z are injected into the trap and then are released sequentially in mass. The mass dependent ion ejection is achieved by ramping of the RF amplitude and with the support of the auxiliary AC signal which promotes the ejection of particular species by resonant excitation of their secular motion. The disadvantage of ITMS is in slow scanning speed (100-1000 ms per scan) and small space charge capacity—less than 3E+3 in 3D traps and less than 3E+5 in linear ion traps. Accounting 0.1-1 sec per scan, the maximal throughput is limited under 3E+6 ion/sec.

Q-Trap mass spectrometers operate with mass selective ejection via the repelling trap edge. To eject ions over the edge barrier, a radial secular motion of particular m/z ions is selectively excited within a linear quadrupole. Due to slow scanning (0.3-1 sec per scan) the throughput of Q-Traps is under 3E+6 ion/sec. The MSAE traps operate at 1E-5 Tor vacuum, which complicates the downstream ion collection and dampening.

This disclosure proposes novel mass separator comprising an array of radio-frequency traps (TA), operating at elevated gas pressures from 10 to 100 mTor Helium, so that to collect ions emitted from a large area (e.g. 10×10 cm) within approximately 1 ms time. In one embodiment, an individual trap is a novel type mass analyzer comprising a quadrupole radiofrequency (RF) trap with radial ion ejection by quadrupolar DC field. In an embodiment, preferably, the array may be arranged on the cylindrical centerline, so that ions are ejected inward the cylinder. Alternatively, ion emitting surfaces may be either plane, or partially cylindrical or spherical.

In another embodiment, the TA comprises an array of linear ion traps with resonant and radial ion ejection. Preferably, the array may be arranged either on a cylindrical centerline and the ejected ions are radial trapped and axial driven within a wide bore cylindrical gas dampening cell. Alternatively, the array is arranged within a plane and the ejected ions are collected by a wide bore ion funnel or an ion tunnel. Preferably, the trap array may be filled with Helium at 10-30 mTor gas pressure.

In a group of embodiments, a fragmentation cell, such as CID cell, is proposed between said trap array and the EFP-MR-TOF for comprehensive, all-mass MS-MS analysis.

Trap arrays with approximately 100 channels of 10 cm long are capable of handling 1E+8 ions per cycle. The EFP method allows rapid time profiling of the incoming ion flow at 10 us time resolution, which in turn allows dropping TA cycle time down to 10 ms, this way bringing the trap array throughput to 1E+10 ions/sec.

Resistive Ion Guides

Fast ion transfer may be effectively arranged within RF ion guides with superimposed axial DC gradient. Prior art resistive ion guides suffer from practical limitations, such as instability of thin resistive films or RF suppression within bulk ferrites. The present invention proposes an improved resistive ion guide employing bulk carbon filled resistors of SiC or B4C materials, improved RF coupling with DC insulated conductive tracks, while using standard RF circuit with DC supply via central taps of secondary RF coils.

TOF Detectors

A majority of present time-of-flight detectors, like dual microchannel plate (MCP) and secondary electron multipliers (SEM) have life time measuring 1 Coulomb of the output charge. Accounting for 1E+6 detector gains, the detector may serve less than 1000 seconds at 1E+10 ion flux. A Daly detector is long known, wherein ions hit metal converter and secondary electrons are collected by electrostatic field onto a scintillator, followed by a photo multiplier tube (PMT). The life time of sealed PMT can be as high as 300C. However, the detector introduces significant time spread (tens of nanoseconds) and introduces bogus signals due to formation negative secondary ions.

An alternative hybrid TOF detector comprises sequentially connected microchannel plate (MCP), scintillator and PMT. However, both MCP and scintillator fail under 1C. Scintillators are degraded due to destruction of sub-micron metal coating. Accounting lower gain of single stage MCP (1E+3), the life time extends to 1E+6 seconds (one month) at 1E+10 ions/sec flux.

To overcome prior art limitations, this disclosure proposes an isochronous Daly detector with an improved scintillator. Secondary electrons are steered by a magnetic field and are directed onto a scintillator. The scintillator is covered by metal mesh to ensure charge removal. Two photo multipliers collect secondary photons at different solid angles, thus improving dynamic range of the detector. At least one-high gain PMT has conventional circuitry for limiting electron avalanche current. The life-time of the novel detector is estimated above 1E+7 seconds (1 year) at 1E+10 ions/sec flux, thus making the above described tandems practical.

Data System

Conventional TOF MS employ an integrating ADC, wherein signal is integrated over multiple waveforms, synchronized with TOF start pulses. The data flux is reduced proportionally to number of waveforms per spectrum to match the speed of the signal transfer bus into a PC. Such data system naturally matches TOF MS requirements, since weak ion signals require waveform integration to detect minor species.

The EFP-MRTOF requires retaining time course information of the rapidly changing waveform during the tandem cycle and recording of long waveforms (up to 100 ms). Long waveforms may be summed during integration time, which is still shorter compared to time of chromatographic separation. In case of using gas chromatography (GC) with 1 sec peaks, the integration time should be notably shorter, say 0.1-0.3 second. Thus, limited number of waveforms (3-30) can be integrated. To reduce the data flow via bus, preferably the signal may be zero-filtered. Alternatively, a zero-filtered signal may be transferred into a PC in so-called data logging mode, wherein non-zero data strings are recorded along with the laboratory time stamp. Preferably, the signal is on-the-fly analyzed and compressed with either multi-core PC or with multi-core processors, such as video cards.

Conclusion

The proposed set of solutions is expected to provide MS-only and C-MS-MS at high R2=100,000 resolution and high (~10%) duty cycle of MR-TOF for 1E+10 ion/sec ion flux, thus, substantially improving a variety of mass spectrometric devices as compared to the prior art.

SUMMARY

The proposed methods and apparatuses are designed to overcome charge throughput limitations of prior art mass spectrometers and of comprehensive tandem MS, while effectively utilizing up to 1E+10 ion/sec ion fluxes, delivering high resolution (R>100,000) of mass spectral analysis with time resolution comparable to chromatographic time scale 0.1-1 sec. Novel method and apparatuses are proposed, along with multiple improved components for reaching the same goal.

In one embodiment, there is provided a method of high charge throughput mass spectral analysis comprising the steps of: (a) generating ions in a wide m/z range in an ion source; (b) within first mass separator, crude separating of an ion flow in time according to ionic m/z with resolution between 10 and 100; and (c) high resolution R2>50,000 mass spectral analysis in a time of-flight mass analyzer, triggered at period being much shorter compared to ion flight time in said time-of-flight separator, such that to minimize or avoid spectral overlaps between signals produced by individual starts at injection of ions of a narrower m/z window due to temporal separation in the first separator.

Preferably the method may further comprise a step of ion fragmentation between said stages of mass separation and mass analysis, wherein triggering pulses of said time-of-flight analyzer are time encoded for unique time intervals between any pair of triggering pulses within a flight time period. Preferably, said step of crude mass separation may comprise a time separation within a multichannel ion trap or within a wide bore and spatial focusing time-of-flight separator preceded by a multichannel trap pulse converter. Preferably, the method may further comprise a step of bypassing said first separator for a portion of time and admitting a portion of ion flow from said ion source into said high resolution mass analyzer, such that to analyze most abundant ion species without saturating space charge of said TOF analyzer or to avoid saturation of a detector.

In another embodiment, there is provided a more detailed method of high charge throughput mass spectral analysis comprising the following steps: (a) for a chromatographically separated analyte flow, in an ion source, generating a plurality of ions in a wide range of ion m/z and passing said ion flow with up to 1E+10 ion/sec into an radio-frequency ion guide at an intermediate gas pressure; (b) splitting said ion flow between multiple channels of a radiofrequency confining ion buffer; (c) accumulating said flow in said ion buffer and periodically ejecting at least a portion of the accumulated ion ensemble into a multichannel trap; (d) dampening ions in said multichannel trap in collisions with Helium gas at gas pressure between 10 and 100 mTor in multiple RF and DC trapping channels; the number of said trapping channels N>10 and the length of individual channels L are chosen such that the product L*N>1 m; (e) sequentially ejecting ions out of said multichannel trap progressively with ion m/z either in direct or reverse order, so that ions of different m/z will be separated in time with resolution R1 between 10 and 100; (f) accepting the ejected and time separated ion flow from said multichannel trap into a wide open RF ion channel and driving ions with a DC gradient for rapid transfer with time spread less than 0.1-1 ms. (g) spatially confining said ion flow by RF fields while maintaining the prior achieved time separation with less than 0.1-1 ms time spread; (h) forming a narrow ion beam with ion energy between 10 and 100 eV, beam diameter less than 3 mm and angular divergence of less than 3 degree at the entrance of an orthogonal accelerator; (i) forming ion packets with said orthogonal accelerator at a frequency between 10 and 100 kHz with uniform pulse period or pulse period being encoded to form unique time intervals between said pulses; due to crude separation in step (e), said packets contain ions of at least 10 times narrower mass range compared to initial m/z range generated in said ion source; (j) analyzing ion flight time of said ion packets with momentarily narrow m/z range in multi-reflecting electrostatic fields of a multi-reflecting time-of-flight mass analyzer with ion flight time for 1000 Th ions of at least 300 us and with mass resolution above 50,000; and (k) recording signals past the time-of-flight separation by a detector with sufficient life time to accept over 0.0001 Coulomb at the detector entrance.

Preferably, the method may further comprise a step of ion fragmentation between said steps of mass sequential ejection and said step of high resolution time-of-flight mass analysis. Preferably, for the purpose of extending dynamic range and for analyzing major analyte species, the method may further comprise a step of admitting and analyzing with said high resolution TOF MS of at least a portion of the original ion flow of wide m/z range. Preferably, said step of crude mass separation in trap array comprises one step of the list: (i) ion radial ejection out of linearly extended RF quadrupole array by quadrupolar DC field; (ii) resonant ion radial ejection out of linearly extended RF quadrupole array; (iii) mass selective axial ion ejection out of RF quadrupole array; (iv) mass selective axial transfer within an array of RF channels having radial RF confinement, an axial RF barrier, and axial DC gradient for ion propulsion, all formed by distributing DC voltage, RF amplitudes and phases between multiple annular electrodes; and (v) ion ejection by DC field out of multiple quadrupolar traps fed by ions through an orthogonal RF channel. Preferably, said mass separator array may be arranged either on a planar, or at least partially cylindrical or spherical surface, said separator may be geometrically matched with ion buffers and ion collecting channels of the matching topology. Preferably, said step of crude mass separation may be arranged in Helium at gas pressure from 10 to 100 mTor for accelerating ion collection and transfer past said step of crude mass separation. Preferably, the method further comprise a step of an additional mass separation between said step of sequential ion ejection and step of ion orthogonal acceleration into multi-reflecting analyzer, wherein said step of additional mass separation comprises one step of the list: (i) mass dependent sequential ion ejection out of an ion trap or trap array; (ii) mass filtering in a mass spectrometer, said mass filtering is mass synchronized with said first mass dependent ejection.

In yet another embodiment, there is provided a tandem mass spectrometer apparatus comprising: (a) A comprehensive multi-channel trap array for sequential ion ejection according to their m/z in T1=1 to 100 ms time at resolution R1 between 10 and 100; (b) An RF ion channel with sufficiently wide entrance bore for collecting, dampening, and spatial confinement of the majority of said ejected ions at 10 to 100 mTor gas pressure; said RF ion channel having axial DC gradient for sufficiently short time spread $\Delta T<T1/R1$ to sustain the temporal resolution of the first comprehensive mass separator; (c) A multi-reflecting time-of-flight (MR-TOF) mass analyzer; (d) An orthogonal accelerator with frequent encoded pulsed acceleration placed between said multi-channel trap and said MR-TOF analyzer; (e) A clock generator for generating start pulses for said orthogonal accelerator, wherein period between said pulses is at least 10 times shorter compared to flight time of heaviest m/z ions in said MR-TOF analyzer, and wherein the time intervals between said pulses are either equal or encoded for unique intervals between any pair of pulses within the flight time period; and (f) A time-of-flight detector with a life time exceeding 0.0001 Coulomb of the entrance ion flow.

Preferably, said apparatus may further comprise a fragmentation cell between said multi-channel trap array and said orthogonal accelerator. Preferably said multi-channel trap array comprises multiple traps of a group: (i) linearly extended RF quadrupole with quadrupolar DC field for radial ion ejection; (ii) linearly extended RF quadrupole for resonant ion radial ejection; (iii) RF quadrupole with DC axial plug for mass selective axial ion ejection; (iv) annular electrodes with distributed DC voltages, RF amplitudes and phases between electrodes to form an RF channel with radial RF confinement, an axial RF barrier, and an axial DC gradient for ion propulsion; and (v) quadrupolar linear trap fed by ions through an orthogonal RF channel for ion ejection by DC field through an RF barrier. Preferably, said mass separator array may be arranged either on a planar, or at least partially cylindrical or spherical surface, said separator are geometrically matched with ion buffers and ion collecting channels of the matching topology.

In another embodiment, there is provided an array of identical linearly extended quadrupolar ion traps, each trap comprising: (a) at least four main electrodes extended in one Z direction to form a quadrupolar field at least in the centerline region oriented along the Z-axis; (b) said Z-axis is either straight or curved with a radius being much larger compared to distance between said electrodes; (c) an ion ejection slit in at least one of said main electrodes; said slit is aligned in said Z-direction; (d) Z-edge electrodes located at Z-edges of said quadrupolar trap to form electrostatic ion plugging at said Z-edges; said Z-edge electrodes being a segment of main electrodes or annular electrodes; (e) an RF generator providing RF signals of opposite phases to form a quadrupolar RF field at least in the centerline region of main electrodes; (f) a variable DC supply providing DC signals to at least two rods to form a quadrupolar DC field with a weaker dipolar DC field at least in the centerline region of main electrodes; (g) a DC, RF or AC supply connected to said Z-edge electrodes to provide axial Z-trapping; (h) a gas supply or pumping means to provide gas pressure in the range from 1 to 100 mTor; (i) wherein said variable DC supply has means for ramping said quadrupolar potential, thus, causing sequential ion ejection via said slit in the reverse relation to ion m/z; and (j) wherein said trap array further comprises a wide bore RF channel with DC gradient for ion collection, transfer and spatial confinement past said slits of quadrupolar traps; the dimension of said RF channel being defined by trap sizes and topology and gas pressure.

Preferably said individual traps may be aligned such that to form an ion emission surface being either planar, or at least partially cylindrical or partially spherical for a more efficient ion collection and transfer in said wide bore RF channel.

In another embodiment, there is proposed an ion guide comprising: (a) electrodes extended in one Z-direction; said Z-axis is either straight or curved with radius much larger compared to distance between said electrodes; (b) said electrodes being made of either carbon filled ceramic resistors, or silicon carbide, or boron carbide to form bulk resistance with specific resistance between 1 and 1000 Ohm*cm; (c) conductive Z-edges on each electrodes; (d) Insulating coating on one side of each rod; said coatings are oriented away from the guide inner region surrounded by said electrodes; (e) at least one conductive track per electrode attached on the top of said insulating coating; said conductive track is connected to one conductive electrode edge; (f) an RF generator having at least two sets of secondary coils with DC supplies being connected to central taps of said sets of secondary coils; thus providing at least four distinct signals $DC_1+\sin(wt)$, $DC_2+\sin(wt)$, $DC_1-\sin(wt)$, and $DC_2-\sin(wt)$; said signals being connected to electrode ends such that to create an alternated RF phase between adjacent electrodes and an axial DC gradient along the electrodes.

Preferably, said DC voltages may be pulsed or fast adjusted at time constant comparable or longer than period of said RF signal. Preferably, said electrodes are either circular rods or plates.

In another embodiment, there is provided a long life time-of-flight detector comprising: (a) a conductive converter surface exposed parallel to time front of detected ion packets and generating secondary electrons; (b) at least one electrode with side window; (c) said converter being negatively floated compared to surrounding electrodes by a voltage difference between 100 and 10,000V; (d) at least two magnets with magnetic field strength between 10 and 1000 Gauss for bending electron trajectories; (e) a scintillator floated positively compared to said converter surface by 1 kV to 20 kV and located past said electrode window at 45 to 180 degrees relative to said converter; and (f) a sealed photo-multiplier past the scintillator.

Preferably, said scintillator is made of antistatic material or said scintillator is covered by a mesh for removing charge from the scintillator surface.

All above aspects of the invention appear to be necessary to provide the general and detailed method and apparatus without compromising the target performance.

BRIEF DESCRIPTION OF THE DRAWINGS

Various embodiments of the present invention together with arrangement given illustrative purposes only will now be described, by way of example only, and with reference to the accompanying drawings in which.

Like reference symbols in the various drawings indicate like elements.

DETAILED DESCRIPTION

Generalized Method and Embodiment

Figure 1:
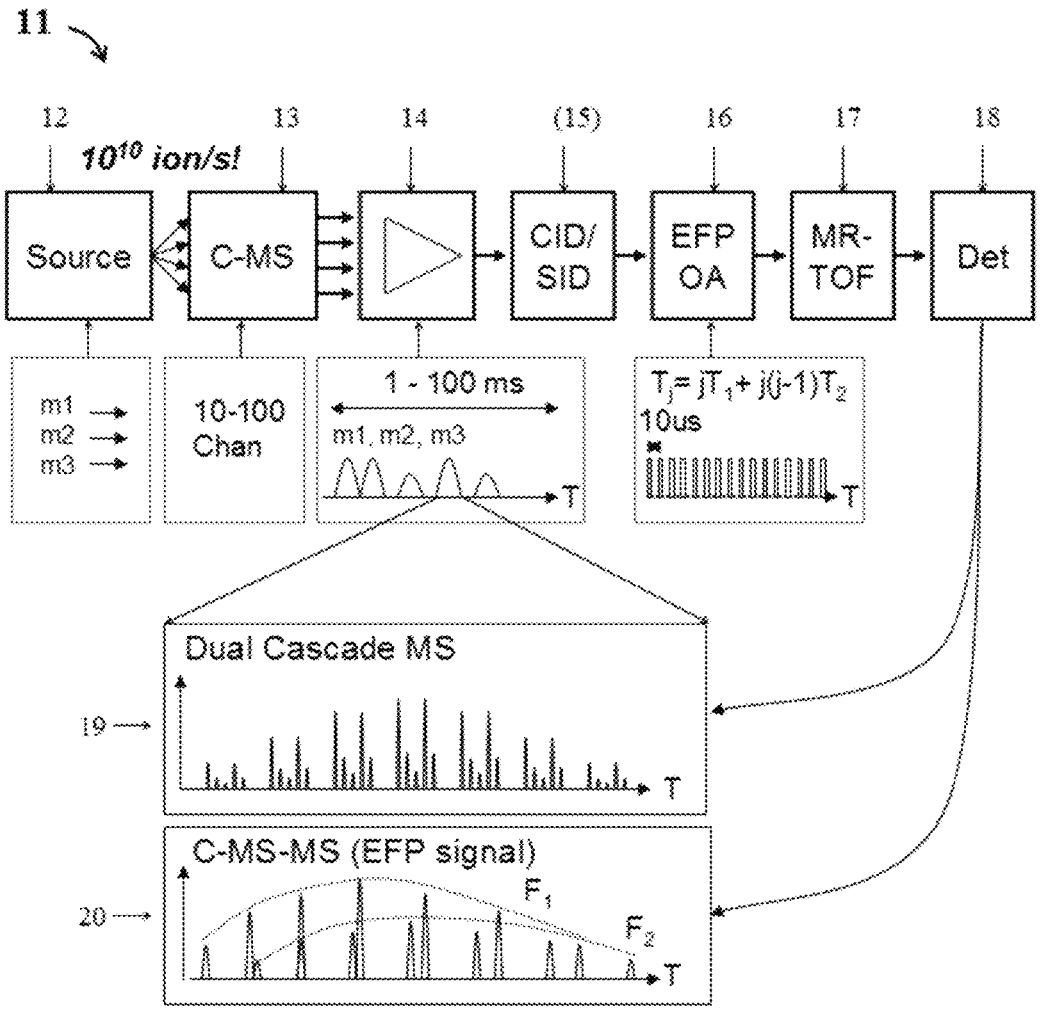
FIG. 1 is a schematic diagram of preferred embodiment in the most general form, also used to illustrate two general method of the invention—dual cascade MS and comprehensive MS-MS method.

Referring to FIG. 1 at a level of block schematic, a mass spectrometer 11 of the present invention comprises: an ion source 12; a high throughput, crude and comprehensive mass separator 13; a conditioner of time separator flow 14, a pulsed accelerator 16 with frequent encoded pulses (EFP); a multi-reflecting time-of-flight (MR-TOF) mass spectrometer 17; and an ion detector with an extended life-time 18. Optionally, a fragmentation cell 15, like CID or SID cell is inserted between said conditioner 14 and said pulsed accelerator 16. Mass spectrometer 11 further comprises multiple not shown standard components, like vacuum chamber, pumps and walls for differential pumping, RF guides for coupling between stages, DC, RF power supplies, pulse generators, etc. Mass spectrometer also comprises not yet shown components which are specific per particular embodiment.

It is understood that the high throughput mass spectrometer of the invention is primarily designed for combination with an upfront chromatographic separation, like liquid chromatography (LC), capillary electrophoresis (CE), single or dual stage gas chromatography (GC and GC×GC). It is also understood, that a variety of ion sources are usable, such as Electrospray (ESI), Atmospheric Pressure Chemical Ionization (APCI), Atmospheric and intermediate pressure Photo Chemical Ionization (APPI), Matrix Assisted Laser Desorption (MALDI), Electron Impact (EI), Chemical Ionization (CI), or conditioned glow discharge ion source, described in WO2012024570.

In one preferred method, herein called "dual cascade MS", ion source 12 generates an ion flow comprising multiple species of the analyzed compounds within a wide m/z range, so as rich chemical background forming multiple thousands of species at 1E-3 to 1E-5 level compared to major species. The m/z multiplicity is depicted by m1, m2, m3 shown under the source box 12. Typical 1-2 nA (i.e. 1E+10 ion/sec) ion currents are delivered into radio-frequency (RF) ion guides at intermediate gas pressures of 10-1000 mTorr air or Helium (in case of GC separation). The continuous ion flow is admitted into a crude and comprehensive separator 13, converting the entire ion flow into a time separated sequence aligned with ion m/z. The "comprehensive" means that most of m/z species are not rejected, but rather separated in time within 1 to 100 ms time span, as shown on a symbolic icon under the box 14. Particular comprehensive separators (C-MS), like various trap arrays separators are described below, while particular TOF separators are to be described in a separate co-pending application. Preferably, for reducing space charge limitations, the C-MS separator comprises multiple channels, as shown by multiple arrows connecting boxes 12, 13 and 14. The time separated flow enters the conditioner 14 which slows down the ion flow and reduces its phase space, symbolized by a triangle in the box 14. The conditioner is designed to have minor to negligible effect onto a time separation. Below are described various conditioners, such as wide bore RF channels followed by converging RF channel. A pulsed accelerator 16 operates at high frequency about 100 kHz, optionally with encoded pulse intervals, as shown in the icon under box 16. The accelerator 16 frequently injects ion packets into MR-TOF analyzer 17. Since the momentarily ion flow is presented by a relatively narrow m/z range, corresponding to a narrow interval of flight times in MR-TOF, the frequent ion injection may be arranged without spectral overlaps on MR-TOF detector 18 as shown in the signal panel 19. The fast operation of the accelerator may be both—periodic or preferably EFP-encoded, e.g. for avoiding systematic signal overlaps with pick up signals from accelerator. The direct ejection sequence (heavy ions come later) of the separator 13 is preferred, since overlap is avoided even at maximal separation speed. If not pushing the speed of the separator, the reverse ejection sequence (heavy m/z comes first) is feasible.

Due to crude time separation in the first MS cascade, the second cascade –MR-TOF may be operated at high frequency (~100 kHz) and at high duty cycle (20-30%) without overloading the space charge capacity of the MR-TOF analyzer and without saturating the detector. Thus, the described dual stage MS, i.e. the tandem of crude separator 13 and of high resolution MR-TOF 17, provides mass analysis at high overall duty cycle (tens of percents), at high resolution of MR-TOF (50,000-100,000), at extended space charge throughput of the MR-TOF and without stressing requirements of the detector 18 dynamic range.

In one numerical example, the first mass spectrometer 13 separates ion flow at resolution R1=100 in 10 ms time, i.e. a single m/z fraction arrives to an accelerator 16 during 100 us; the flight time for heaviest m/z in MR-TOF is 1 ms; and accelerator operates at 10 us pulse period. Then a single m/z fraction would correspond to 10 pulsed accelerations and each pulse would generate a signal corresponding to 5 us signal string. Obviously, signals from adjacent pulses (spread by approximately 10 us) do not overlap on the detector 18. Ion flow of 1E+10 ions/sec is distributed between 1E+5 pulses a second, providing up to 1E+4 ions per pulse into the MR-TOF, accounting realistic efficiency of the accelerator (described below). Fast pulsing lowers space charge limitations of the analyzer and avoids saturation of the detector dynamic range. The scan rate of the first cascade may be accelerated up to 1 ms (e.g. when using TOF separator), or slowed down to 100 ms (e.g. for implementing dual stage trap separator), still not affecting the described principle, unless the first separator has sufficient charge capacity per scan period to handle the desired charge flow of 1E+10 ion/sec, which is to be analyzed in below description of particular separator embodiments.

The dynamic range of dual stage MS 11 may be further improved if alternating between dual MS and single MS modes. In a portion of time, at least a portion of the original ion flow may be injected directly into the MR-TOF analyzer, operating either in EFP or standard regime of the accelerator, in order to record signals for major ionic components, though at low duty cycle, but still providing sufficiently strong signals for major components.

In another preferred method, the crude C-MS separator 13 generates a time separated ion flow aligned with ion m/z. The flow is directed into a fragmentation cell 15, directly, or via a conditioner 14. The cell 15 induces ion fragmentation for parent ions within a relatively narrow momentarily m/z window. The flow of fragment ions is preferably conditioned to reduce the flow phase space and then pulsed injected into MR-TOF 17 by accelerator 16, operating at fast average rate of 100 kHz. The pulse intervals of the accelerator 16 are preferably encoded to form unique time intervals between any pair of pulses. As an example, time of the current j-numbered pulse is defined as $T(j)=j*T_1+j(j-1)*T_2$, wherein $T_1$ may be 10 us and $T_2$ may be 5 ns. The method of encoded frequent pulsing (EFP) is described in WO2011135477, incorporated herein by reference. Signal on MR-TOF detector does have spectral overlaps, since fragment ions are formed within a wide m/z range. The exemplar segment of detector signal is shown in the panel 20, where two series of signals are shown for ion fragments of different m/z and are annotated by F1 and F2. However, an efficient spectral decoding is expected since the momentarily spectral population is substantially reduced compared to standard EFP-MR-TOF.

Note that the parent mass resolution may be further increased by so-called time deconvolution procedure. Indeed, extremely fast OA pulsing and recording of long spectra with duration matching the cycle time of the separator 13 do allow to reconstruct the time profiles of individual mass components with 10 us time resolution. Then fragment and parent peaks may be correlated in time, which allows separating adjacent fragment mass spectra at time resolution which is lower than the time width of parent ion ejection profile past the separator 13. The principles of deconvolution have been developed for GC-MS in late 60 s by Klaus Bieman.

In a numerical example, the first separator forms a time-separated m/z sequence with resolution R1=100 and with 10-100 ms duration; an MR-TOF having 1 ms flight time operates with EFP-pulsing at 100 kHz average repetition rate; long spectra are acquired corresponding to the entire MS-MS cycle and may be summed for few cycles, if chromatographic timing permits. Fragment spectrum per one m/z fraction of parent ions lasts for 0.1-1 ms and corresponds to 10-100 pulses of the accelerator, which should be sufficient for spectral decoding. The method is well suited for analysis of multiple minor analyte components. However, for major analyte components, the momentarily flux may be concentrated up to 100-fold. Even accounting the signal splitting between multiple fragment peaks, the momentarily maximum number of ions per shot may be as high as 1E+4 to 1E+5 ions on the detector, which exceeds both—space charge capacity of the MR-TOF analyzer and the detector dynamic range. To increase the dynamic range, the C-MS-MS tandem 11 may be operated in alternated mode, wherein for a portion of time, the signal intensity is either suppressed or time spread. Alternatively, an automatic suppression of space charge may be arranged within the MR-TOF analyzer, such that intense ion packets will spread spatially and will be transferred at lower transmission. Merits on the charge throughput and speed of the tandem 11 are supported in the below description.

Main Effects of the Method

1. In a dual cascade MS method, the upfront crude mass separation allows pulsing MR-TOF at high repetition rate without forming spectral overlaps, thus handling large ion flows up to 1E+10 ion/sec at high duty cycle (20-30%), at high overall resolution of R2=100,000 and without stressing space charge and detector limits of the instrument. For clarity let us call this operational method as "Dual-MS".

2. In comprehensive MS-MS (C-MS-MS) method, tandem mass spectra may be acquired for all parent ions at ion flow up to 1E+10 ion/sec, at approximately 10% duty cycle, at parent ion resolution R1=100, and fragment spectral resolution R2=100,000 without stressing space charge limits of the MR-TOF analyzer and without stressing detector dynamic range.

3. In C-MS-MS mode, the resolution of parent mass selection may be further improved by time deconvolution of fragment spectra, similarly to deconvolution in GC-MS. A two dimensional deconvolution would be also accounting chromatographic separation profiles.

4. Both methods—dual-MS and C-MS-MS, may be implemented within the same apparatus 11, just by adjusting ion energy at the entrance of the fragmentation cell, and or switching between regimes with low and high duty cycle of the accelerator operation.

5. The tandem operation and EFP method are employed with the goal of detecting multiple minor analyte components at chromatographic time scale. For a portion of time, the same apparatus may be used in conventional method of operation for acquiring signals of major components, thus further enhancing the dynamic range.

Embodiment with a Trap Array

Figure 2:
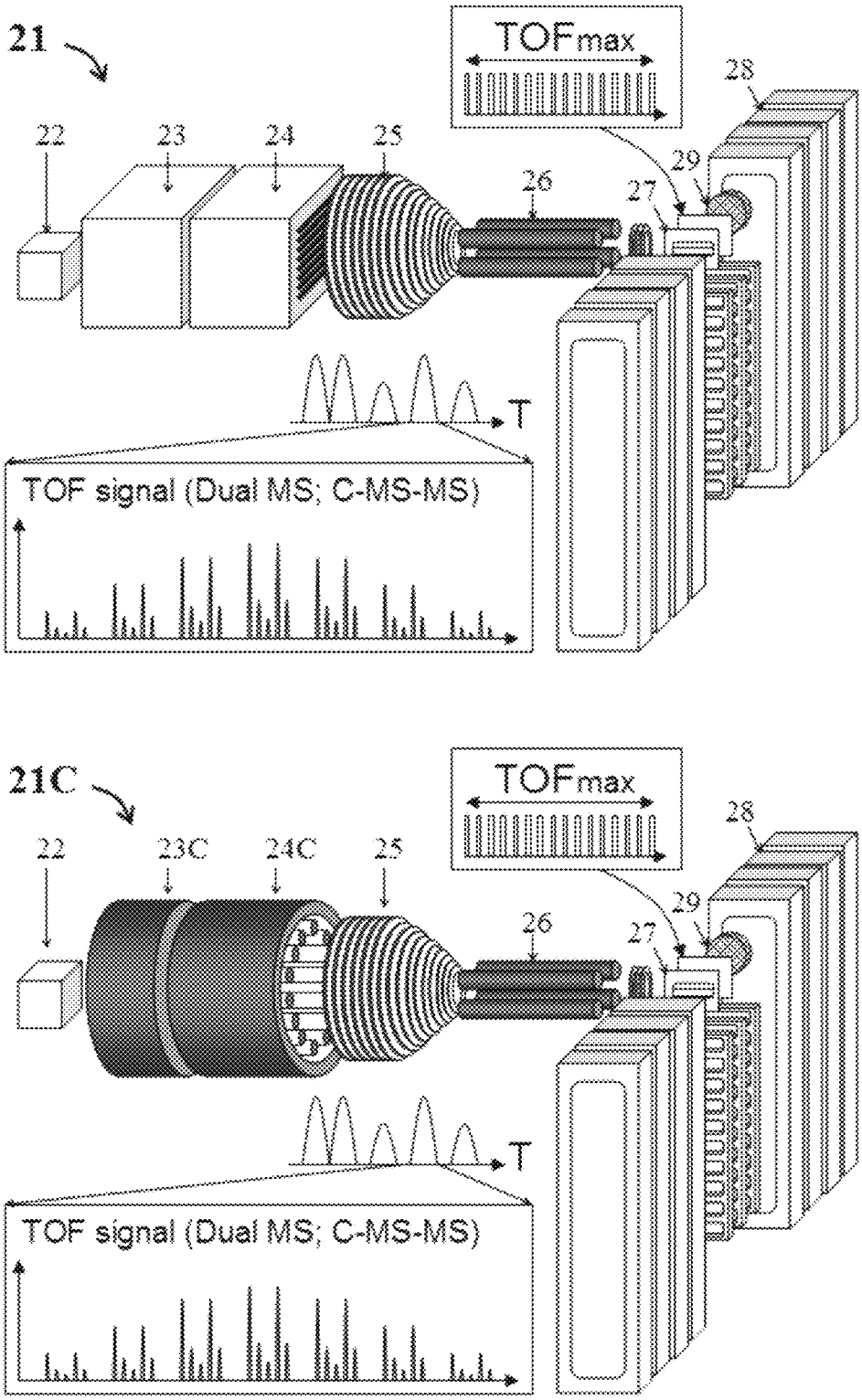
FIG. 2 is a scheme for a preferred embodiment with the trap array separator and multi-reflecting TOF (MR-TOF) mass spectrometer operating with encoded frequent pulses (EFP); two particular embodiments are shown with planar and cylindrical arrangements of trap array.

Referring to FIG. 2, and at a level of block schematic, a mass spectrometer 21 of the present invention comprises an ion source 22, an accumulating multi-channel ion buffer 23, an array of parallel ion traps 24, a wide bore damping RF ion channel 25, an RF ion guide 26, an orthogonal accelerator 27 with frequent encoded pulses (EFP), a multi-reflecting mass spectrometer 28, and an ion detector 29 with an extended life-time. Optionally, ion guide 25 may serve as a fragmentation cell, like CID cell. Mass spectrometer 21 further comprises multiple not shown standard components, like vacuum chamber, pumps and walls for differential pumping, RF guides for coupling between stages, DC, RF power supplies, pulse generators, etc.

Two embodiments 21 and 21C are shown, which differ by topology of the buffer and of the trap array, corresponding to planar 23, 24 and cylindrical 23C, 24C arrangements. A planar emitting surface of the trap array 24 may be also curved to form a portion of cylindrical or spherical surfaces. In the cylindrical arrangement 21C, trap 24C ejects ions inward, and the inner part of the cylinder serves as a wide bore ion channel, lined with resistive RF rods to accelerate ion transfer by an axial DC field. Otherwise both embodiments 21 and 21C operate similarly.

In operation, ions are formed in ion source 22, usually preceded by a suitable chromatographic separator. Continuous and slowly varying (time constant is 1 sec for GC and 3-10 sec for LC) ion flow comprises multiple species of the analyzed components so as rich chemical background forming multiple thousands of species at 1E-3 to 1E-5 level compared to major species. Typical 1-2 nA (i.e. 1E+10 ion/sec) ion currents are delivered into radio-frequency ion guides at intermediate gas pressures of 10-100 mTorr air or Helium (GC case).

The continuous ion flow is distributed between multiple channels of ion buffer 23 with radio-frequency (RF) ion confinement operating at intermediate gas pressures from 10 mTor to 100 Tor. Preferably, Helium gas is used to tolerate higher ion energies at mass ejection step. Buffer 23 accumulates ions continuously and periodically (every 10-100 ms) transfers the majority of ion content into the trap array 24. Ion buffer 23 may comprise various RF devices, such as an array of RF-only multipoles, an ion channel, or an ion funnel, etc. To support 1E+10 ions/sec ion flux, the buffer has to hold up to 1E+9 ions every 100 ms. As an example, a single RF quadrupole of 100 mm length can hold up to 1E+7 to 1E+8 ions in a time. Thus, the ion buffer should have ten to many tens of individual quadrupole ion guides. Preferably, quadrupole rods are aligned on two coaxial centerline surfaces. Preferably, quadrupole rods are made resistive to allow a controlled ion ejection by axial DC field. It may be more practical employing coaxial ion channels, ion tunnels or ion funnels. Preferably such devices comprise means for providing axial DC field for controlled ion ejection. An improved resistive multipole is described below.

Trap array 24 periodically admits ions from ion buffer 23. Ions are expected to be distributed between multiple channels and along the channels by self space charge within 1-10 ms times. After trap array 24 is filled, the trap potentials are ramped such that to arrange a mass dependent ion ejection, thus forming an ion flow where ions are sequentially ejected according to their m/z ratio. In one embodiment, the trap channels are aligned on a cylindrical centerline. Ions are injected inward the cylinder into a wide-bore channel 25 with an RF ion confinement and with an axial DC field for rapid ion evacuation at 0.1-1 ms time scale. The RF channel 25 has a converging section. Multiple embodiments of trap arrays 24 and of RF channels 25 are described below. For discussing the operational principles of the entire set, let us assume that the trap array provides time separation of ion flow with mass resolution of 100 within 10-100 ms cycles, i.e. each separated fraction has 0.1-1 ms time duration.

From a converging section of the RF channel 25 ions enter ion guide 26, normally set up in a differentially pumped chamber and operating at 10-20 mTor gas pressures. The ion guide 26 preferably comprises a resistive quadrupole or a multipole. An exemplar ion guides are described below. The guide continuously transfers ions in approximately 0.1-0.2 ms time delay and substantially less than 0.1 ms time spread. As an example, a 10 cm multipole guide operating with 5V DC at 10 mTor Helium would transfer ions in approximately 1 ms, still not inducing fragmentation. The time spread for ions of narrow m/z range is expected to be 10-20 us. The guide is followed by a standard (for MR-TOF) ion optics (not shown) which allows reducing gas pressure and forms a substantially parallel ion beam at 30 to 100 eV ion energy (dependent on MR-TOF design). The parallel ion beam enters an orthogonal accelerator 27.

The accelerator 27 is preferably an orthogonal accelerator (OA) oriented substantially orthogonal to the plane of ion path in MR-TOF 28, which allows using longer OA, as described in US20070176090, incorporated herein by reference. An MR-TOF analyzer is preferably a planar multi-reflecting time-of-flight mass spectrometer with a set of periodic lens as described in WO2005001878. At typical OA length 6-9 mm (dependent on MR-TOF mirror design) and at typical ion energy 50 eV, ions of m/z=1000 have 3 mm/us velocity and pass the OA in 2-3 microseconds. At present technology, high voltage pulse generators can be pulsed as fast as 100 kHz (pulse period 10 us), bringing the OA duty cycle to 20-30%. If excluding ion separation in the trap array 24, the time-of-flight spectra would be heavily overlapping. With account of the trap separation, the incoming ion beam has narrow mass fraction, i.e. from 1000 to 1010 amu. Typical flight time in MR-TOF 28 is 1 ms, thus each individual OA pulse would generate signal between 1 and 1.005 ms. Thus, the OA may be pulsed at 10 us period without forming ion spectral overlaps. Thus, the upfront mass separation in the first MS cascade allows pulsing MR-TOF at high repetition rate without forming spectral overlaps, while providing approximately 10% overall duty cycle, accounting 20-30% duty cycle of the OA and 2-3 fold beam collimating losses prior to the OA. The instrument then records spectra of 1E+10 ion/sec incoming flux and 1E+9 ion/sec ion flux on the MR-TOF detector 29 at 10% overall duty cycle and at R2=100,000 resolution, which helps detecting minor analyte components at chromatographic times.

High (10%) duty cycle of the instrument 22 does stress the dynamic range at higher end. In the dual cascade MS mode, the strongest ion packets (assuming high concentration of single analyte) may reach up to 1E+6 ions per shot, accounting 100-fold time concentration in the separator 22, 100 kHz OA frequency, and 10% efficiency of the OA operation. Such packets definitely would overload the MR-TOF space charge capacity and dynamic range of the MR-TOF detector. The invention proposes a solution: the instrument 22 supports two modes—dual cascade MS mode for recording weak analyte components and a standard operational mode wherein ion flow is directly injected from the ion buffer 23 into the RF channel 25, e.g. during the trap 24 loading time. In standard operational mode, the maximal ion packet would have approximately 1E+4 ions, i.e. at the edge of the MR-TOF space charge capacity. For completely safe operation, the detector should have overload protection, e.g. by limiting circuits at latest stages of PMT. An additional protecting layer is preferably arranged by space charge repulsion in the MR-TOF analyzer 28, which is controlled by strength of periodic lens in the analyzer.

Again referring to FIG. 2, the same tandem 21 may be operated as a comprehensive MS-MS when activating ion fragmentation, e.g. by inducing ions at sufficiently high (20-50 eV) ion energy into resistive ion guide 26, this way effectively converted into a CID cell. In operation, time separated flow of parent ions in a narrow m/z range (e.g. 5 amu for net 500 amu and 10 amu for net 1000 amu) enters the CID cell 26 within approximately 0.1-1 ms time. The mass window is slightly wider than the width of isotopic groups. The group enters a fragmentation cell and forms fragment ions, e.g. by collisional dissociation. The fragments continuously enter the OA 26. The OA is operated in the EFP mode, described in WO2011135477. In brief, the pulse intervals are coded with non-uniform time sequence, e.g. as $T_i=i*T1+i(i+1)/2*T2$ with typical T1=10 us and T2=10 ns. Though fragment spectra are overlapped, the overlapping of any particular pair of peaks is not repeated systematically. Normal type TOF spectra are recovered at spectral decoding step, accounting pulse intervals and analyzing overlaps between peaks series. Because of the limited spectral population characteristic for fragment spectra, the EFP spectral decoding becomes effective. As a result, fragment spectra are recorded for all parent species at parent resolving power R1·100, at fragment resolving power R2~100,000, at approximately 10% overall duty cycle and handling ion fluxes up to 1E+10 ion/sec.

Let us estimate the dynamic range of the C-MS$^2$ method. The maximal ion packet may contain up to 1E+4 ions, accounting 1E+10 ion/sec total ion flux, no more than 10% signal content in the major analyte component (if looking at major components, there is no need for C-MS-MS), 100-fold time compression in the separator 23, 10% overall duty cycle of the OA 27 (also accounting spatial ion losses prior to OA), and 100 kHz pulse rate of the OA. Such strong ion packets would be recorded in MR-TOF at lower resolution. However, mass accuracy in MR-TOF is known to stand up to 1E+4 ions per packet. An additional protection may be set by lowering periodic lens voltage for automatic suppression of strong signals by self space charge repulsion within the MR-TOF analyzer. To catch strong signals, the resolution (and hence the time concentration of signal) of the first separator 23 may be periodically lowered. Thus, maximal signals may be recorded for compounds corresponding to 1E+9 ion/sec incoming ion flux. For estimating minimal signals let us account that competitive Q-TOF instruments obtain informative MS-MS spectra when the total fragment ion signal is above 1E+3 per parent at the detector. Thus, the dynamic range per one second is estimated as DR=1E+5, being a ratio of major acquired signal per second 1E+8 and of minor recorded spectrum 1E+3 ions. The integral dynamic range, i.e. ratio of total signal per smallest identified specie is Int-DR=1E+6 per second, which is about two orders higher compared to filtering tandems, like Q-TOF, wherein additional ion losses are induced by selection of single parent ion at a time.

The above description assumes the ability of trap array handling 1E+10 ion/sec fluxes. The existing ion traps are not capable of handling ion fluxes above 1E+6 to 1E+7 ion/sec. To increase the ion flux, while sustaining an approximately 100 resolution, the invention proposes several novel trap solutions, which are described prior to considering trap arrays.

RF Trap with Quadrupole DC Ejection

Figure 3:
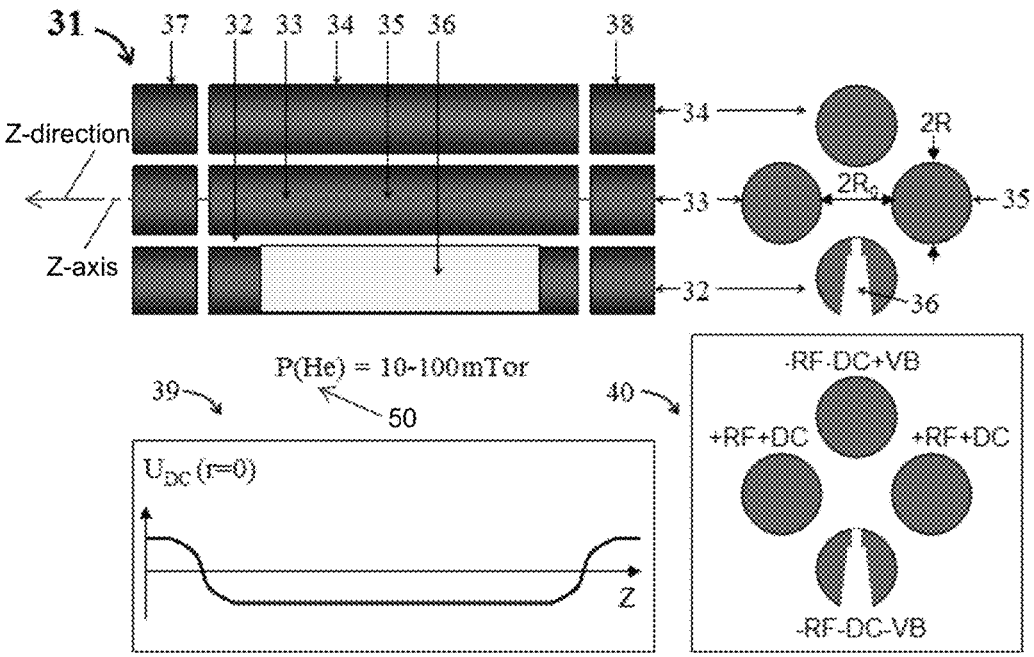
FIG. 3 is a scheme of a novel quadrupolar trap with a sequential ion ejection by DC quadrupolar field.

Referring to FIG. 3 a novel trap 31 with quadrupolar DC ejection is proposed for crude mass separation at resolution R1-100. The trap comprises: a linear quadrupole with parallel electrodes 32, 33, 34, 35 elongated in a Z direction; so as end plugs 37, 38 for electrostatic ion trapping in the Z-direction. The electrode 32 has a slit 36 aligned with the trap axis Z. Preferably, the end plugs 37, 38 are segments of electrodes 32-35 biased by few Volts DC as shown by axial DC distribution in the icon 39. Alternatively, the end plugs are DC biased annular electrodes. The trap is filled by pumping means 50 with helium at pressure between 10 and 100 mTorr.

Both RF and DC signals are applied as shown in the icon 40 to form quadrupole RF and DC fields, i.e. one phase (+RF) and +DC are applied to one pair of electrodes 33 and 35, and the opposite phase (−RF) and −DC are applied to another pair of electrodes 32 and 34. Optionally a dipolar voltage bias VB is applied between electrodes of one pair, namely between electrodes 32 and 34. It is understood, that to create RF and DC difference between electrode pairs, each type of signals could be applied separately. As an example, RF signal may be applied to electrodes 33 and 35 with DC=0, while −DC signals can be applied to pair 32 and 34.

In one embodiment, the electrodes are parabolic. In another embodiment, the electrodes are round rods with radius R related to the inscribed trap radius $R_0$ as $R/R_0=1.16$. In alternative embodiments, the ratio $R/R_0$ varies between 1.0 and 1.3. Such ratio provides a weak octupole component in both RF and DC fields. In yet another embodiment, the trap is stretched in one direction, i.e. distances between rods in X and Y directions are different in order to introduce a weak dipolar and sextupole field components.

The electrode arrangement of the trap 31 apparatus reminds a conventional linear trap mass spectrometer with resonant ejection (LTMS) described e.g. in U.S. Pat. No. 5,420,425, incorporated herein by reference. The apparatus difference is primarily in use of quadrupolar DC field for ion ejection, and because of lower requirement on resolution (R=100 Vs 1000-10,000 in LTMS) in parameters difference—in length (100-200 mm Vs 10 mm in LTMS), unusually high helium pressure 10 to 100 mTor Vs 1 mTor in LTMS. The method differs by the employed mechanism of ion ejection, by scan direction, and by operational regimes. While LTMS scans RF amplitude and applies AC voltage for excitation of the secular motion, the novel trap 21 provides mass dependent ejection by quadrupolar DC field which is opposed to mass dependent radial RF confinement. In a sense, the operational regime is similar to operation of the quadrupole mass spectrometer, wherein the upper mass boundary of the transmitted mass window is defined by a balance between DC quadrupole field and an RF effective potential. However, quadrupoles operate in deep vacuum, they separate a passing through ion flow, and the operation is based on developing secular motion instability. Contrary the novel trap 21 operates with trapped ions and at the elevated gas pressure which is small enough to suppress RF micro-motion, but large enough to partially dampen the secular motion, thus suppressing resonance effects. The elevated pressure is primarily chosen to accelerate ion damping at ion admission into the trap, so as to accelerate the collection, damping and transfer of the ejected ions.

Figure 4A:
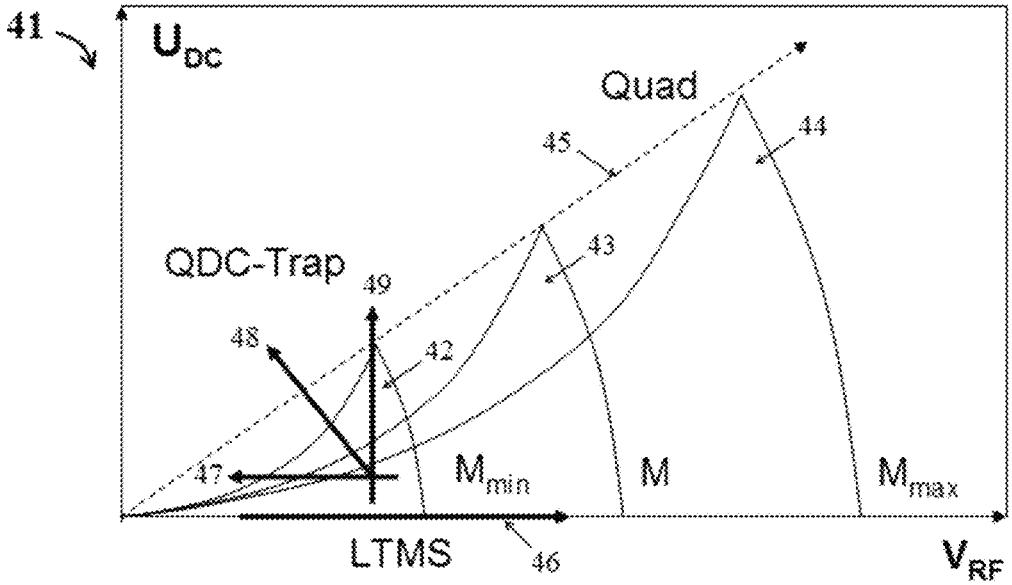
FIG. 4A is a stability diagram in quadrupolar traps to illustrate operation method of the trap if FIG. 3.

Referring to FIG. 4A, the operational regimes of quadrupoles and various traps are shown in the conventional stability diagram 41 shown in axes $U_{DC}$ and $V_{RF}$, where $U_{DC}$—is the DC potential between electrode pairs and $V_{RF}$—is the peak to peak amplitude of the RF signal. Ion stability regions 42, 43 and 44 are shown for three ion m/z—minimal m/z in the ensemble $M_{min}$, exemplar intermediate m/z—M, and maximal m/z of the ensemble $M_{max}$. The working line 45 corresponds to operation of quadrupole filters. The line cuts very tips of stability diagrams 42-44, thus, providing transmission of single m/z specie and rejection of others. The line 46 corresponds to operation of the LTMS, with account of resonant excitation of ion secular motion by AC excitation at particular fixed $q=4Vze/\omega^2R_0^2M$. The excited q value is defined by ratio of RF and AC frequencies. As a result of linear ramping up of the RF signal the trap ejects small ions first and heavier ions next, which is called "direct scan".

The effective potential well of the quadrupole field is known to be $D=Vq/4=0.9V_{RF}M_0/4M$, where $M_0$ is the lowest stable mass at q~0.9. The equation shows that the effective barrier is mass dependent and drops reverse proportional to mass. Thus, at small $U_{DC}$, the heavier ions would be ejected by the quadrupole DC field while small ions would stay. When ramping up the DC potential, ions would be sequentially ejected in a so-called reverse scan with heavier ions leaving first. The principle of the trap operation may be understood when considering the total barrier D composed of DC and RF barriers as $D=0.9V_{RF}M_0/4M-U_{DC}$, which is at any given $U_{DC}$ is positive for ions with $M<M^*=4U_{DC}/(0.9V_{RF}M_0)$ and negative for $M>M^*$. In quadrupoles, both RF and DC field components are rising proportionally with radius, thus the boundary between stable (lower mass) and unstable (higher mass) trapped ions remains at the same M*. At an exemplar scanning rate corresponding to 0.1 ms per mass fraction, the stable ions with overall barrier D>10 kT/e~0.25V would not be ejected, since the rate of ion ejection is roughly (1/F)*exp(−De/2 kT), where F is the RF-field frequency, kT—is thermal energy and e is electron charge. The equation accounts that ion kinetic energies in RF fields is double compared to static fields. Thus, the trap resolution may be expressed in volts. For DC barrier of 25V, the estimated resolution is R1=100. At the same time, the kinetic energy of ions passing over the DC barrier is comparable to the height of the DC barrier. In order to avoid ion fragmentation, the trap operates with Helium gas, wherein center of mass energy is factor of $M_{He}/M$ lower. The model allows simple estimate of space charge effects. The trap resolution is expected to drop proportionally to ratio of thermal energy to space charge potential 2 $kT/U_{SC}$. The effective trap resolution at large space charge may be estimated as $R \sim U_{DC}/(U_{SC}+2\ kT/e)$.

The last section of the description presents the results of ion optical simulations, when ramping DC voltage at a rate 1 to 5 V/ms, the time profiles for ions with m/z=100 and 98 are well separated at DC voltage of 20V. The HWFM resolution is in the order of 100 which confirms very simple separation model.

Referring to FIG. 4A, the novel trap 41 operates along the scan lines 47, or 48 or 49. In a most simple (though not optimal) scan 49, the RF signal is fixed (constant $V_{RF}$), while the DC signal is ramped up. The RF amplitude is chosen such that the lowest mass has q under 0.3-0.5 for adiabatic ion motion in RF fields. To avoid too high energies and ion fragmentation at ion ejection, it is preferable lowering the RF amplitude at constant $U_{DC}$ as shown by scan line 49. For highest mass resolution both RF and DC signals should be scanned along the line 48. Such scan may be chosen when using the tandem in C-MS-MS mode, and ion fragmentation is desired anyway.

Figure 4B:
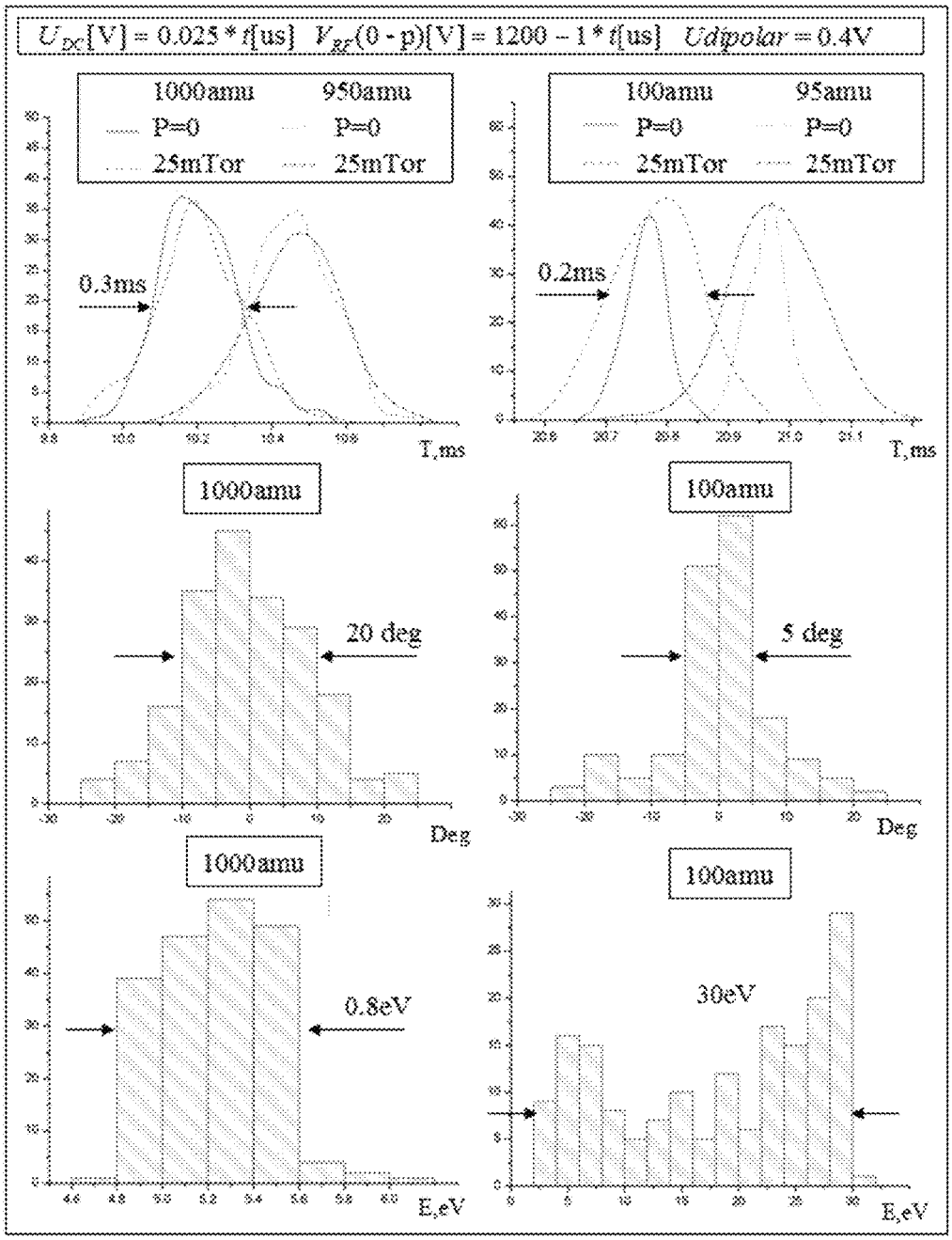
FIG. 4B presents results of ion optical simulation of trap shown in FIG. 3 at ion ejection by quadrupolar field at elevated gas pressures.

Referring to FIG. 4B, and describing results of ion optical simulations, the quadrupolar trap with 6 mm inscribed diameter is operated along the following parameters: $U_{DC}$ [V]=0.025*t[us]; $V_{RF}$(o-p)[V]=1200−1*t[us]; dipolar voltage of +0.2 and −0.2V. The operating gas pressure varied from 0 to 25 mTor of Helium.

The upper row shows time profiles for ions with m/z=1000 and 950 (left) and m/z=100 and 95 (right). Typical profile width is 0.2-0.3 ms can be obtained in 20 ms scan. Mass resolution of 20 corresponds to selection of mass range with 1/40 of the total flight time. Efficiency of ion ejection is close to unity. Ions are ejected within mass dependent angle span varying from 5 to 20 degree (middle row graphs). The kinetic energy can be up to 60 eV for 1000 amu ions while up to 30 eV for 100 amu ions. Such energy is still safe for soft ion transferring in Helium.

The same trap may be operated in regime of resonant ion ejection, similar to LTMS, though differing from standard LTMS by: using trap arrays, operating at much higher spatial charge loads, operating at much larger gas pressures (10-100 mTor compared to 0.5-1 mTo helium in LTMS), running faster though at smaller mass resolution.

Figure 4C:
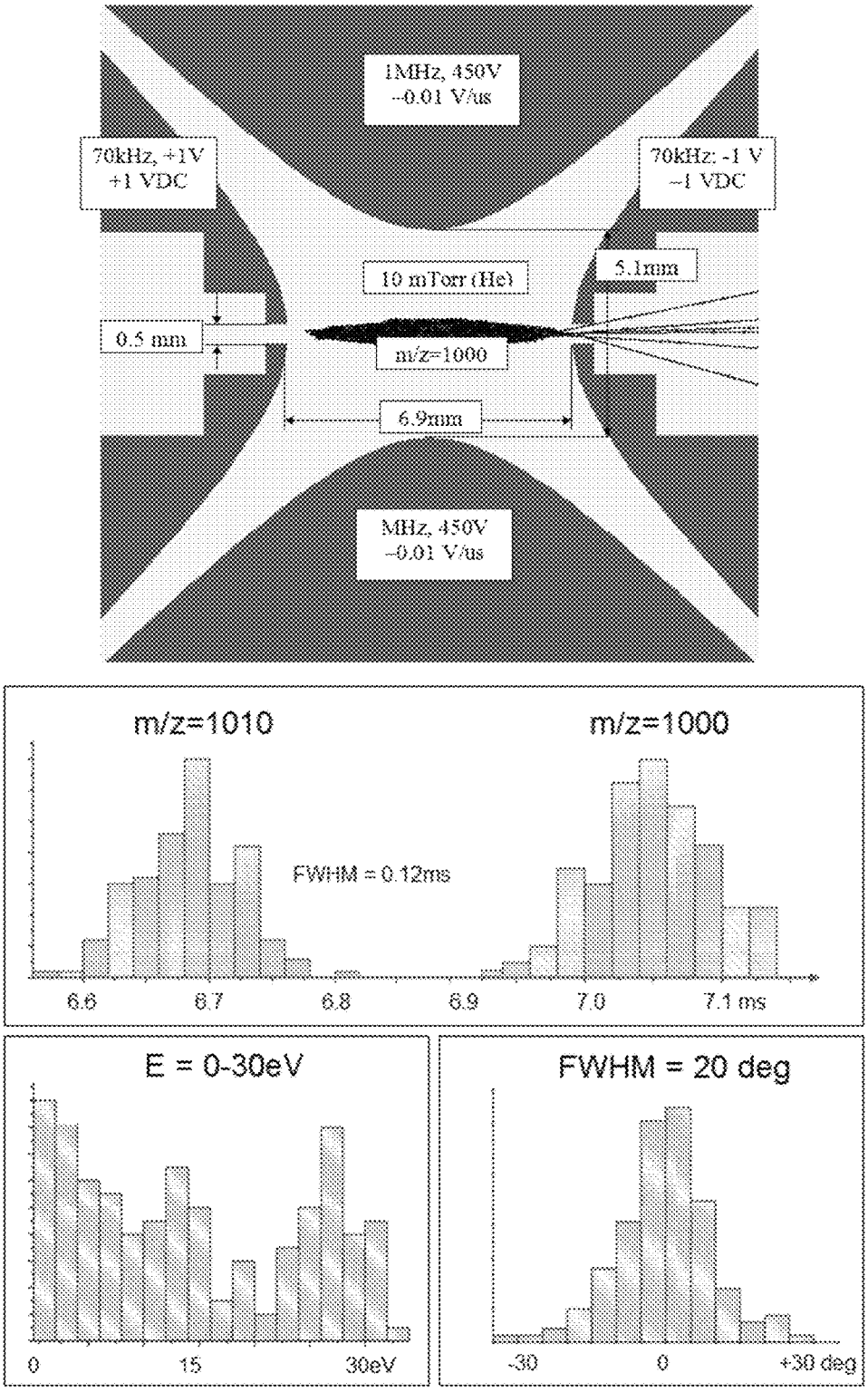
FIG. 4C presents results of ion optical simulation of trap shown in FIG. 3 at resonant ion ejection at elevated gas pressures.

Referring to FIG. 4C, and describing results of ion optical simulations, a linear trap employs a slightly stretched geometry, where distance between one electrode pair is 6.9 mm and between others is 5.1 mm, which corresponds roughly to 10% octupolar field. Applied signals are annotated in the drawing: (a) 1 MHz and 450Vo-p RF signal is applied to vertical spaced rods, the RF amplitude is scanned down at a rate of 10V/ms; (b) dipolar DC signal +1 VDC and −1 VDC is applied between horizontally spaced electrodes; (c) an dipolar AC signal with 70 kHz frequency and 1V amplitude is applied between horizontally spaced rods. The upper graph shows a two time profiles at resonant ejection of ions with 1000 and 1010 amu. The reverse mass scan corresponds to approximately 300 mass-resolution, while the total RF ramp down time is approximately 30-40 ms. As seen from lower graphs, ions are ejected within 20 degree angle and their kinetic energy spreads between 0 and 30 eV, which still allows soft ion collection in Helium gas.

Trap with Axial RF Barrier

Figure 5:
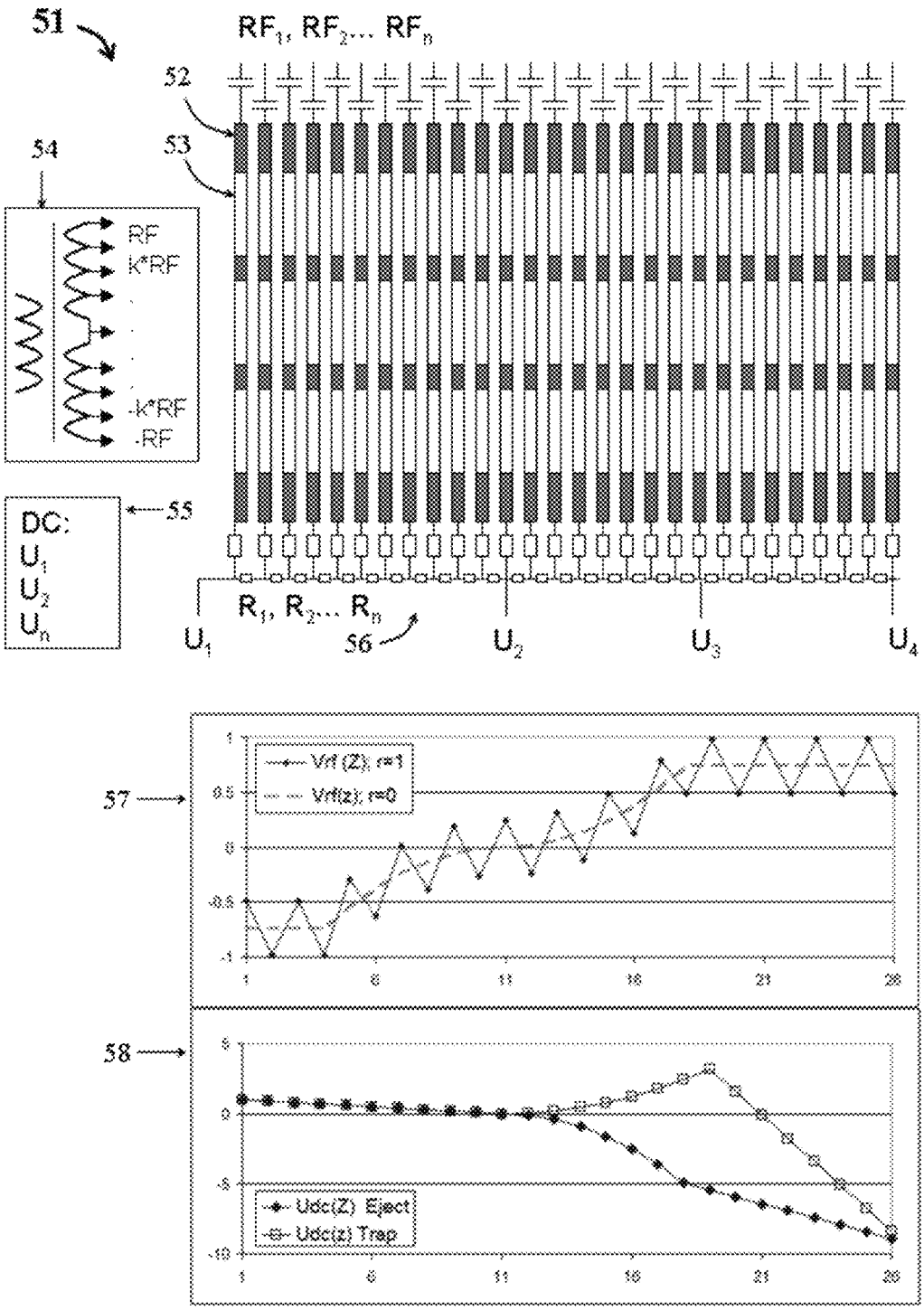
FIG. 5 is a scheme for trap separator with an axial RF barrier, also accompanied with axial distributions of RF and DC fields.

Referring to FIG. 5, a trap 51 with an axial RF barrier comprises a set of plates 52 with aligned multiple sets of apertures or slits 53, an RF supply 54 with multiple intermediate outputs from the secondary RF coil with phase and amplitude annotated as k*RF, a DC supply 55 with several adjustable outputs U1 . . . Un, and a resistive divider 56. The RF signals of both phases taken from intermediate and terminal points of the secondary coils are applied to plates 52 such that to form alternated amplitude or alternated phase RF between the adjacent plates 52 in order to form a steep radial RF barrier, while forming an effective axial RF trap as shown by an exemplar RF distribution on plates in the icon 57. The trap surrounded by the entrance and exit barriers, wherein entrance RF barrier 58 may be lower than the exit one 59. The DC potentials from resistive divider are connected via Mega Ohm range resistors to plates 52, such that to create a combination of axially driving DC gradient with a nearly quadratic axial DC field in the region of RF trap 57. Thus, the axial RF and DC barrier mimic those formed in quadrupoles, at least near the origin point. The trap is filled with gas at 10-100 mTor gas pressure range.

In operation, ion flow comes along the RF channel with alternated RF phases and with axial driving DC voltage being applied to plates 52. To fill the trap, the DC voltage 54*a* is lowered. Then the potential 54*a* is raised above the potential 54*c* to create slight dipolar field within the trap region 57. Next, the potential 54*b* is ramped up to induce sequential mass ejection in the axial direction. The portion of the resistive divider between points 54*a*, 54*b* and 54*c* is selected such that to form nearly quadratic potential distribution. The mass dependent ion ejection then occurs by similar mechanism as described for quadrupolar trap in FIG. 4.

A next similar trap may be arranged downstream after sufficient gaseous dampening segment of the RF channel. Multiple traps may be arranged sequentially along the RF channel. Multiple sequential traps are expected to reduce space charge effects. Indeed, after filtering of a narrower m/z range, the next trap would operate at smaller space charge load, thus, improving trap resolution. Multiple traps may be arranged for "sharpening" of trap resolution, similar to peak shape sharpening in gas chromatography, wherein multiple sorption events with broad time distributions do form time profiles with narrow relative time spread dT/T.

Hybrid Trap with Side Ion Supply

Figure 6:
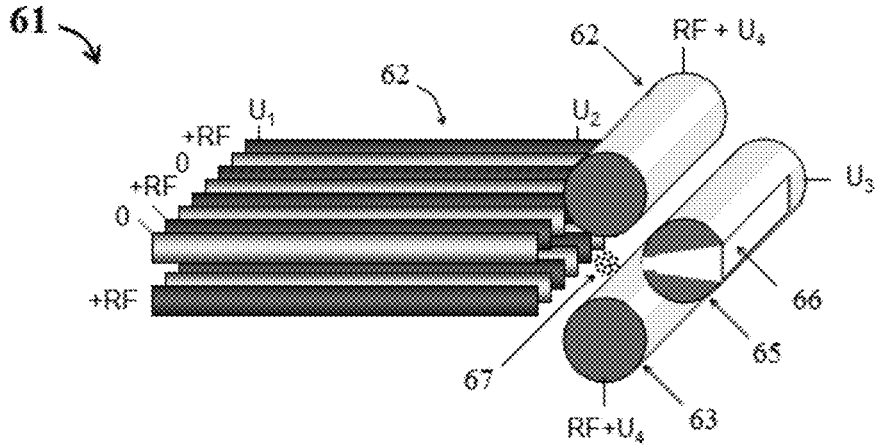
FIG. 6 is a scheme of a novel linear RF trap having side ion supply via an RF channel.

Referring to FIG. 6, yet another novel trap—a hybrid trap 61 is proposed using the same principle of equilibrium opposition of nearly quadrupole RF and DC fields at intermediate gas pressure 10-100 mTor. The trap 61 comprises an RF channel 62; quadrupolar rods 63-65; rod 65 having an ejection slit 66. RF channel 62 is orthogonally oriented to the rods set 63-65, said RF channel is formed of resistive rods supplied with an alternated RF signals (o and +RF) and electrostatic potentials $U_1$ and $U_2$ to array ends. The effective RF at the axis of the channel is RF/2. The RF signal is also applied to rods 63 and 64. An adjustable DC bias U3 is provided to the rod 62 for controlling ion ejection, rapping and mass dependent ejection via slit 66.

In operation, ion flow comes through the RF channel 62. The channel retains ion flow radial due to alternated RF. Optionally, the channel is formed of resistive rods for controlled axial motion by an axial DC gradient $U_1$-$U_2$. The channel 62 is in communication with the trapping region 67 formed by rods 63-64 and a channel acting as a fourth "open rod". The net RF on the axis of the channel 62 is RF/2. Since RF signal on rod 65 is zero and the RF is applied to rods 63 and 64, there appears an RF trap near the origin, which is strongly distorted on one—entrance side (connecting to channel 62), however, still sustaining nearly quadrupolar field near the trap origin. Ions are injected into the trap 61 by arranging a trapping DC field, by adjusting $U_3$ sufficiently high. After ion dampening in gas collisions (taking approximately 1-10 ms at 10 mtor Helium), the DC barrier is adjusted to be higher at the entrance side, i.e. $U_2>U_3$, while reduced at the exit side. Then the quadrupole DC potential composed of U2+U3 of rods 63 and 64 is ramped up such that to create a dipolar DC gradient pushing ions towards the exit. Since the RF barrier is larger for smaller ions, the heavier ions would leave the trap first, thus forming a time separated flow aligned with ion m/z in the reverse order. Compared to RF/DC traps 31 and 51, the trap 61 has an advantage of faster filling of the trap, though one would expect somewhat lower resolution of the trap 61 due to larger distortions of the quadrupolar field.

Space Charge Capacity and Throughput of Traps

Let us assume a trap confining a cylinder of ions with length L and radius r at concentration charge concentration n. The space charge field Esc grows within a cylinder as $Esc=nr/2\varepsilon_0$, thus, forming space charge potential on the ion cylinder surface equal to $U_{SC}=q/4\pi\varepsilon_0 L$. To minimize effects of space charge onto the trap resolution, the space charge potential $U_{SC}$ should be under 2 kT/e. Then the ion ribbon length L has to be $L>N/(8\pi\varepsilon_0 KT)$, where N is the number of stored elementary charges. Assuming median scanning time of the trap as 10 ms, to sustain 1E+10 ion/sec throughput the trap has to hold up to N=1E+8 charges and the ion ribbon length has to be L>3 m. One proposed solution is to arrange a parallel operating trap array. Another proposed solution is to arrange a multiple stage (at least dual stage) trap, wherein the first trap operates with total charge and at low resolution for passing a relatively narrow mass range into the second stage trap, which will operate with a fraction of space charge to provide higher resolution of the sequential mass ejection.

Dual Stage Traps

Figure 7:
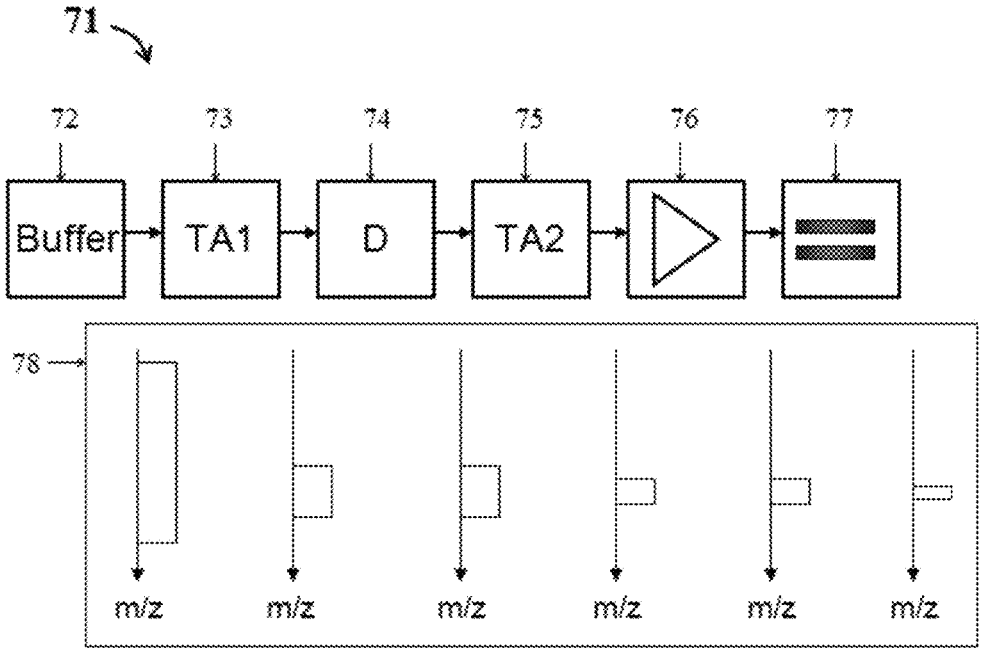
FIG. 7 is a scheme for synchronized dual trap array, optionally followed by a synchronized mass separator.

Referring to FIG. 7, a dual stage trap array 71 comprises a sequentially communicating ion buffer 72, first trap array 73, a gaseous RF guide 74 for ion energy dampening; a second trap array 75, a spatially confining RF channel 76, and an optional mass filter 77 for synchronized passage of even narrower mass range.

In operation, momentarily selected mass ranges are shown in diagram 78. Ion buffer injects ions in a wide m/z range either continuously or in a pulsed mode. Both traps 73 and 75 are arranged for synchronized mass dependent ion ejection such that ion flow is separated in time being aligned with either direct or reverse m/z sequence. The first trap 73 operates at a lower resolution of mass selective ejection, primarily caused by a higher space charge of the ion content. The trap cycle is adjusted between 10 and 100 ms. Accounting up to 1E+10 ion/sec ion flow from the ion source (not shown) the first trap array 73 is filled with approximately 1E+8 to 1E+9 ions. In order to reduce the overall trap electrical capacity, the trap has approximately 10 channels of 100 mm long. The space charge potential in the worse case is estimated as 1.5V for 100 ms cycle at 1E+10 ion/sec corresponding to 1E+9 ions per 1 m overall ion ribbon. For 15-50V DC barrier, the resolution of the first trap is expected between 10 and 30. As a result, the trap 73 will be ejecting ions in 30-100 amu m/z window. The ejected ions will be dampened in gas collisions and then injected into the second trap array 75 for additional and finer separation. The space charge of the second trap is expected to be 10-30 times lower. The space charge potential will become 0.05 to 0.15V, i.e. would allow mass ejection at higher resolution of approximately 100. The dual trap arrangement helps reducing the overall electrical capacity of the trap, since the same effect is reached with 20 individual trap channels compared to a single stage trap which would can require 100 channels, and thus, having larger capacity. An optional mass filter 75, like analytical quadrupole, may be used in addition or instead of the second trap array, once ions are spatially confined and dampened in a confining RF channel 76. The transferred mass range of the mass filter 77 is synchronized to the mass range transmitted by an upstream trap or dual traps.

Even in dual trap arrangements, high charge throughput up to 1E+10 ion/sec may be achieved only in trap array forming multiple channels.

Trap Arrays

To improve charge throughput, multiple embodiments of trap arrays are proposed. The embodiments are designed with the following main considerations: convenience of making; reachable accuracy and reproducibility between individual trap channels; limiting trap overall electrical capacity; convenience and speed of ion injection and ejection; efficiency of trap coupling to ion transfer devices; limitations of differential pumping system.

The trap array may be composed of novel traps described in FIG. 3-FIG. 7, so as of conventional traps with sequential ion ejection, such as LTMS with resonant ion ejection, described by Syka et al in U.S. Pat. No. 5,420,425, or traps with axial ion ejection by resonant radial ion excitation as described by Hager et al in U.S. Pat. No. 6,504,148. The conventional traps may be modified to operate at higher ~10 mTor gas pressure, though at moderate drop of their resolving power.

For efficient and fast ion collection of ions past the trap array there are proposed several geometrical configurations:

A planar array of axially ejecting ion traps with exit ports being located on a plane, or soft bent cylindrical or spherical surface; The planar array is followed by wide bore RF ion channel and then by an RF ion funnel; A DC gradient is applied to RF channel and funnel to accelerate ion transfer past the trap array.

A planar array of radial ejecting traps with exit slits aligned on a plane, or soft bent cylindrical or spherical surface. The planar array is followed by wide bore RF ion channel and then by an RF ion funnel; A DC gradient is applied to RF channel and funnel to accelerate ion transfer past the trap array.

A planar array located on the cylindrical surface with ejecting slits looking inward the cylinder. Ions are collected, dampened and transferred within a wide bore cylindrical channel.

Mechanical Design of Novel Components

Figure 8:
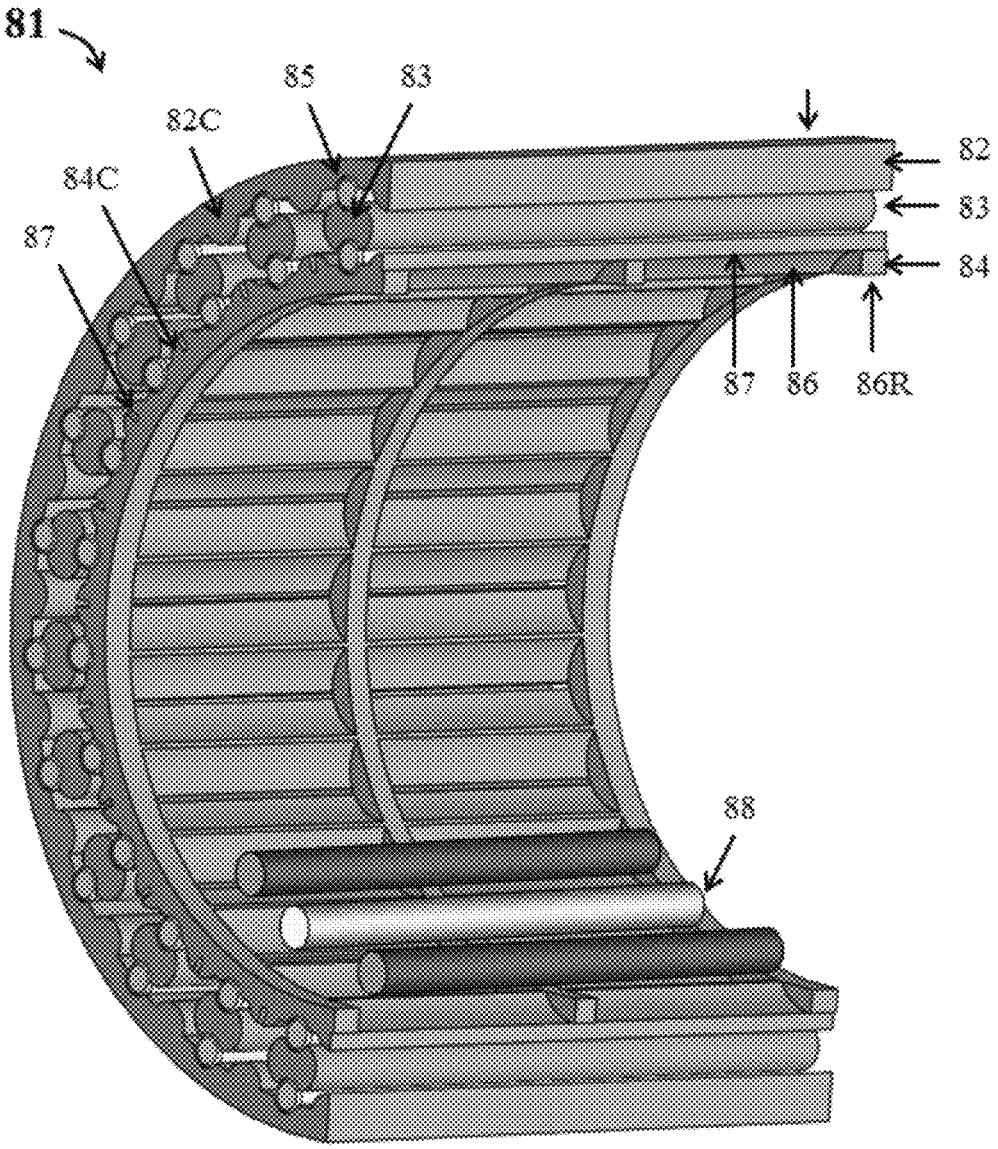
FIG. 8 is an exemplar mechanical design of the cylindrical trap array.

Referring to FIG. 8, an exemplar trap array 81 (also denoted as 24C in FIG. 2) is formed by plurality of identical linear quadrupole traps aligned on the cylindrical centerline. Electrode shape is achieved by electric discharge machining from a single work piece, thus forming an outer cylinder 82 with built in curved electrodes 82C, multiple inner electrodes 83, and an inner cylinder 84 with multiple built in curved electrodes 84C. The assembly is held together via ceramic tube-shaped or rod-shaped spacers 85. The built-in electrodes 82C and 84C may be of parabolic or circular, or rectangular shapes. The inner cylinder 84 has multiple slits 86 alternated with structural ridges 86R, made when matching several machined groves 86 with a full length EDM made slits 87. Characteristic sizes are: inscribed radius 3 mm, centerline diameter 120 mm to form 24 traps, i.e. one trap per every 15 degree, and length of 100 mm. The inner region is lined with resistive rods 88 to form multipole with axial DC field with the overall potential drop from few volts to few tens of volts depending on the gas pressure of Helium, being in 10-100 mTor range.

Figure 9:
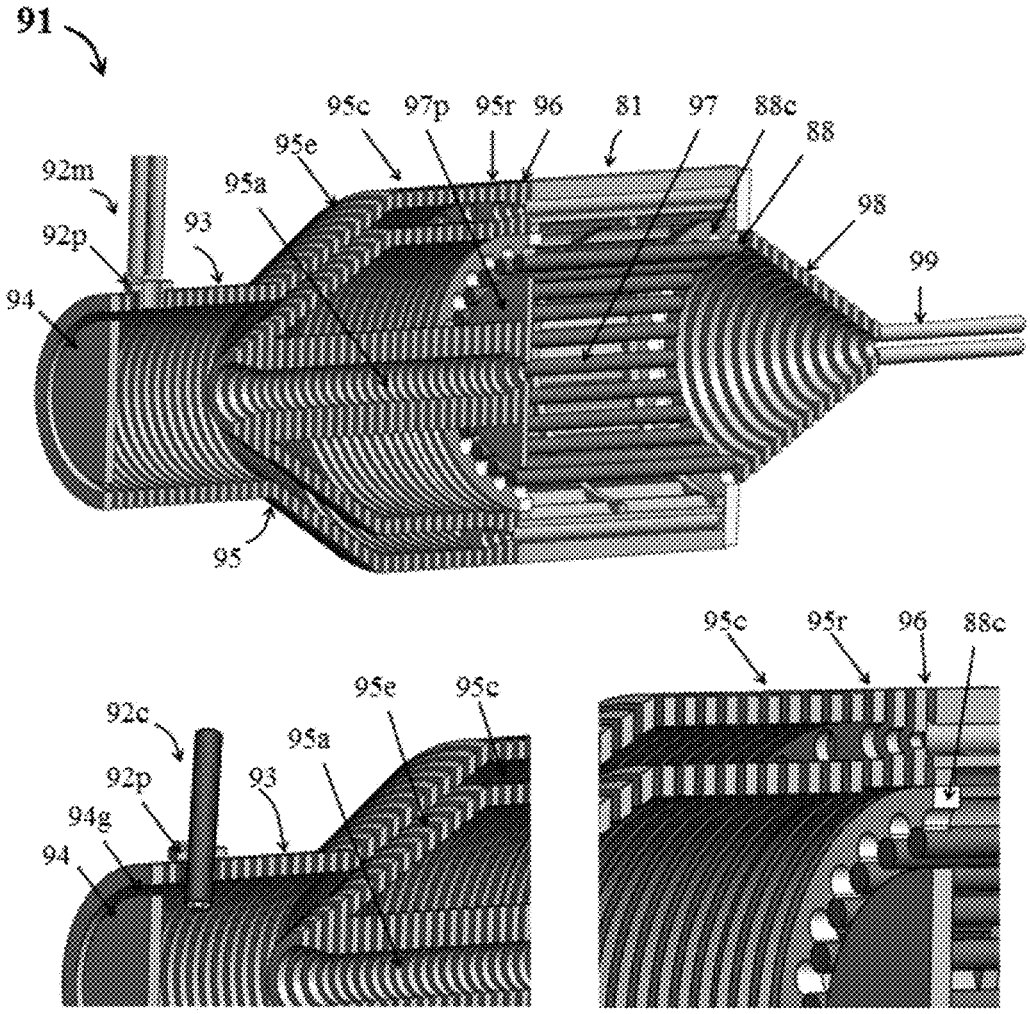
FIG. 9 is an exemplar design for components surrounding cylindrical trap array of FIG. 8.
Figure 10:
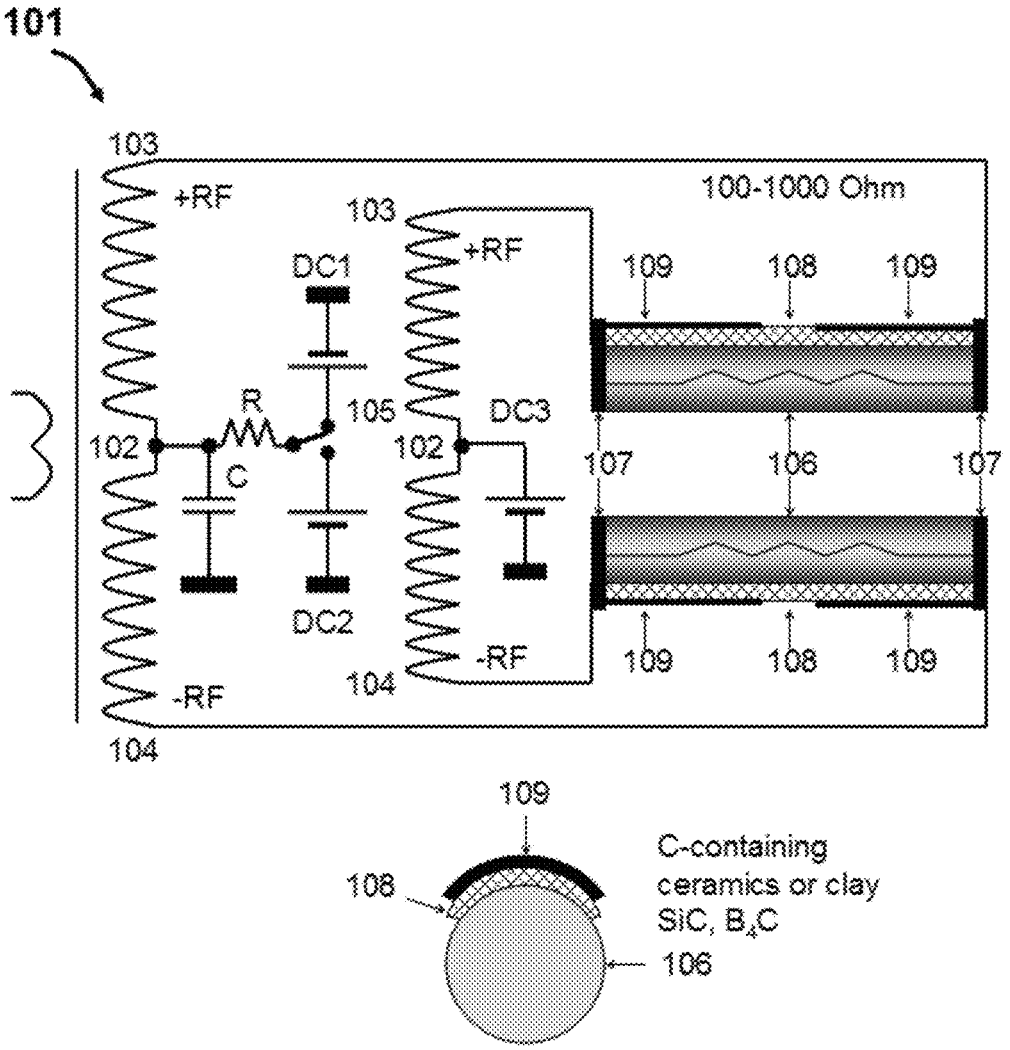
FIG. 10 is an electrical schematic for improved resistive ion guide.

Referring to FIG. 9, the exemplar assembly 91 is also presented for modules surrounding cylindrical trap 81. The full assembly view is complimented with icons showing the assembly details. Ion source (not shown) communicates with the assembly 91 either via multipole 92*m*, or via a heated capillary 92*c* passing through an entrance port 92*p*. The ion entrance port 92*p* may be placed orthogonally to trap axis for injecting ions into a sealed ion channel 93. Gas may be pumped through a gap 94*g* between the ion channel 93 and a repeller electrode 94. The channel 93 is supplied with alternated RF signal and a DC voltage divider for ion transfer into a multistage ion funnel 95, made of thin plates with individual apertures variable from plate to plate, thus forming ion channels with a conical expanding portion 95*e*, then with an optional cylindrical portion 95*c* further diverging into multiple circular channels 95*r* which are aligned with trap 81 channels. Preferably, the multistage ion funnel 95 also has an axial central RF channel 95*a*. Connecting ridges may be used for supporting the inner axial part 95*a* of the ion funnel 95. The last ring 96 with multiple apertures may be supplied with adjustable DC voltage for ion gating. The circular channels 95*r* of the ion funnel are aligned and are in communication with individual channels of the trap 81 which has been described above. The ion collecting channel 97 is formed with resistive rods 88, supplied with both RF and axial DC signals, and an electrostatic repeller plate 97*p*. Resistive rods 88 may be glued by inorganic glue to a ceramic support 88*c*. Ions are collected past resistive rods 88 by a confining ion funnel 98 and are passed into a resistive multipole 99. Optionally, the ion funnel 98 may be replaced with a set of converging resistive rods for radial RF confinement combined with a DC gradient. The presented design shows one possible approach of constructing the trap array using regular machining. It is understood that for Referring to FIG. 10, an exemplar resistive multipolar ion guide 101 (also denoted as 26 in FIG. 2, or 88 in FIG. 8) comprises resistive rods 106 and an RF supply with DC connected via central taps of 102 of secondary coils 103 and 104. Optionally, the DC signal may be pulsed as shown by a switch 105 with a smoothing RC circuit. The rods 106 comprise conductive edge terminals 107. Preferably the outer (not exposed to ions) aide of rods 106 comprise an insulating coating 108 with conductive tracks 109 on top for an improved RF coupling. The rods are placed to form a multipole due to alternated RF phase supplying between adjacent rods. Since there are two groups of equally energized rods, the electrical schematic of in FIG. 10 shows only two poles.

The rods 106 are preferably made of carbon filled bulk ceramic or clay resistors commercially available from US resistors Inc or HVP Resistors Inc. Alternatively, rods are made of silicon carbide or boron carbide, which is known to provide 1-100 Ohm*cm resistance range depending on sintering methods. The individual rod electrical resistance of 3 to 6 mm diameter and 100 m long rods is chosen between 100 and 1000 Ohm for optimal compromise between (a) dissipated power at approximately 10 VDC drop and (b) RF signal sagging due to stray capacity per rod in 10-20 pF range which corresponds to reactive resistance Rc-1/ωC being approximately 5-10 kOhm. To use higher rod impedance, the RF coupling may be improved by DC insulated thick metalized track 109 on the outer (not exposed to ions) side of electrodes 106 being coupled to one (any) edge terminal 107 and insulated from rod 106 by an insulating layer 108. Such conductive tracks and insulators can be made for example with insulating and conducting inorganic glues or pastes, commercially available e.g. from Aremco Co. Resistive rods are fed with RF and DC signals using long known RF circuit, wherein DC voltage is supplied via central taps 102 of multiple secondary RF coils 103 and 104. When using resistive rods 88 for ion liner of the trap 81, the overall capacity of the ion guide (0.5-1 nF) becomes a concern at RF driver construction. The resonant RF circuit may employ powerful RF amplifiers or even vacuum tubes, as in ICP spectrometry.

Prior art resistive guides GB2412493, U.S. Pat. No. 7,064,322, U.S. Pat. No. 7,164,125, U.S. Pat. No. 8,193,489 employ either bulk ferrites which suppress RF signal along rods and have poor resistance linearity and reproducibility, or thin resistive films which can be destroyed by occasional electrical discharges at large RF signals at intermediate gas pressures. Present invention proposes a reproducible, robust and uniform resistive ion guide, besides being stable in a wide temperature range.

The mechanical design of the guide 101 may be using metal edge clamps for precise alignment of ground or EDM machined rods and for avoiding thermal expansion conflicts. Alternatively, rods 88 are glued by inorganic paste to ceramic holders 88*c* as shown in FIG. 8, wherein one holder is fixed and another holder is axially aligned but is linearly floated to avoid thermal expansion conflicts. Preferably, the rods are center-less grinded for accurate alignment which allows making accurate rods with diameter down to 3 mm.

It is understood that assemblies described designs in FIG. 8 to FIG. 10 allow forming multiple other particular configurations and combinations of the described elements forming hybrid ion channels and guides with planar, curved, conical or cylindrical ion channels, communicating with an array of individual channels. The particular configurations are expected to be optimized based on the desired parameters of individual devices, such as space charge capacity, ion transfer velocity, accuracy of the assembly, insulation stability, electrode electrical capacity, etc.

Long Life TOF Detector

Existing TOF detectors are characterized by the life time measured as 1 Coulomb of the output charge. Accounting 1E+6 typical gain this corresponds to 1E-6C at the entrance. Thus, the detector life time is only 1000 seconds (15 min) at 1E+9 ion/sec ion flux. Commercially available are hybrid detectors comprising front single stage MCP followed by a scintillator and then by a PMT. In own experiments the detector serves about 10 times longer, i.e. still not enough. Apparently, the hybrid detector is degraded because of destroying 1 micron metal coating on the top of the scintillator. The invention provides an improvement in detector life time achieved by:

(a) Covering a scintillator by conductive mesh for removing electrostatic charge from a surface;

(b) Using a metal converter at high ion energy (approximately 10 kEV) in combination with magnetic steering of secondary electrons; and (c) using dual PMT with different solid angle for collecting signal into channels, while setting circuits within PMT for an active signal cut-off at downstream magnifying stages.

Figure 11:
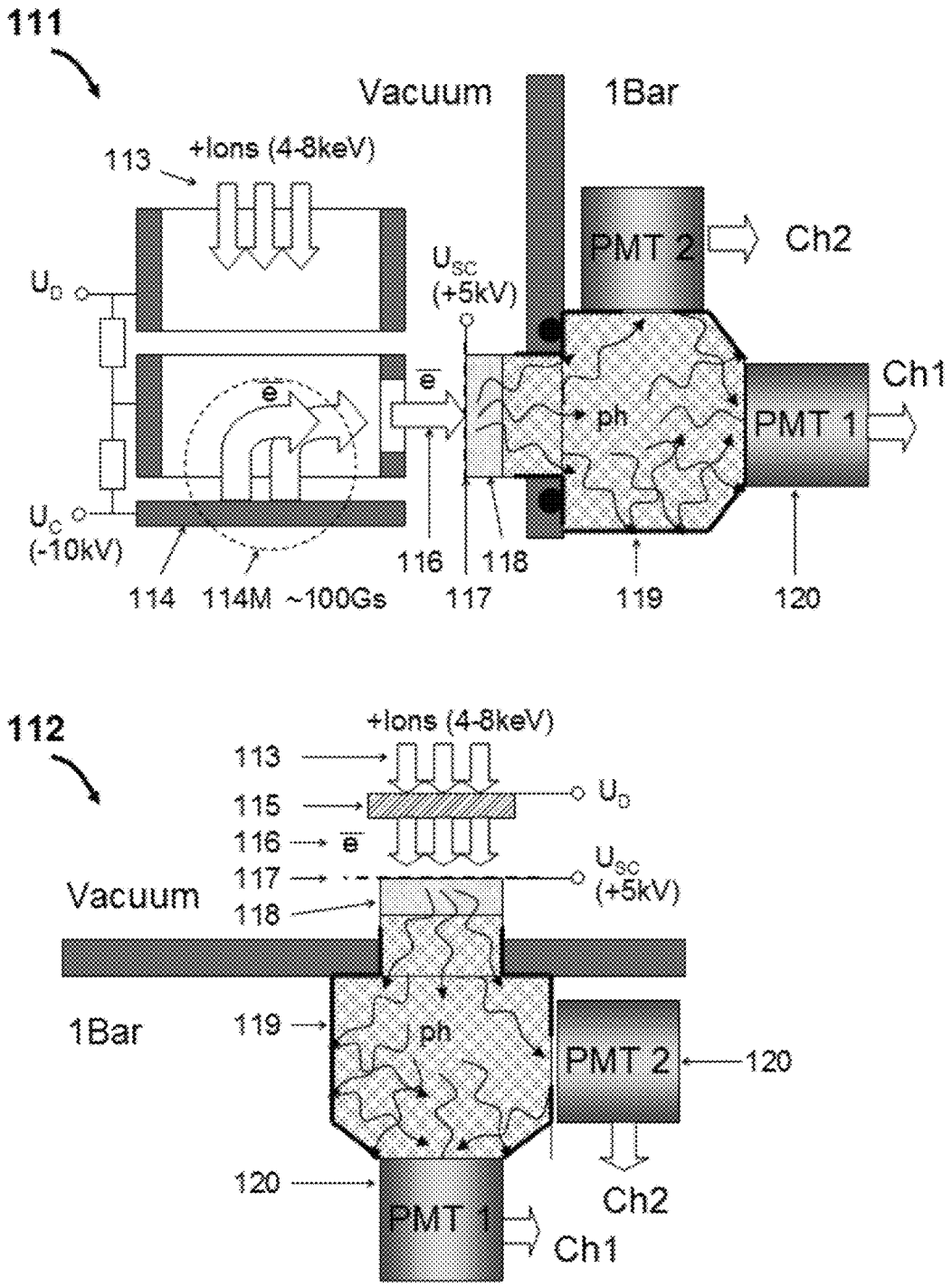
FIG. 11 is a schematic of novel TOF detector with extended life time.

Referring to FIG. 11, two types of improved TOF detectors 111 and 112 share multiple common components. Both detectors 111 and 112 comprise: a scintillator 118; a mesh 117 coating the scintillator; a photon transparent pad 119 with reflective coating; and at least one photomultiplier 120, preferably located at atmospheric side. Preferably two photomultipliers 120 are employed for collecting photons at different solid angles. Embodiments 111 and 112 differ by type of ion to electron conversion: the detector 111 employs a metal converter surface 114 with magnet 114M having magnetic field between 30 and 300 Gauss and with magnetic lines oriented along the surface. The detector 112 employs a single stage microchannel plate 115.

In operation, a packet of ions 113 at 4-8 keV energy approaches detector 111. The ion beam is accelerated by several kilovolts difference between $U_D$ and a more negative $U_C$ potentials, e.g. within a shown simple three electrode system. Ions at approximately 10 keV energy hit metal conversion surface 114 and generate secondary electrons, primarily by kinetic emission. Ion bombardment at high energy hardly causes any surface contamination. Unlike specially designed conversion surfaces, the plane metal surface (stainless, copper, beryllium copper, etc) will not degrade. Secondary electrons are accelerated by a more negative potential $U_C$ and get steered by magnetic field between 30 and 300 Gauss (preferably 50-100 Gauss) of magnets 114M. Secondary electrons are directed into a window along trajectory 116 and hit scintillator 118.

The scintillator 118 is preferably fast scintillator with 1-2 ns response time, like BC418 or BC420, or BC422Q scintillators by St. Gobain (scintillators@Saint-Gobain.com), or a ZnO/Ga (http://scintillator.lbl.gov/E. D. Bourret-Courchesne, S. E. Derenzo, and M. J. Weber. Development of ZnO:Ga as an ultra-fast scintillator. Nuclear Instruments & Methods in Physics Research Section a—Accelerators Spectrometers Detectors and Associated Equipment, 601: 358-363, 2009). To avoid electrostatic charging, the scintillator 118 is covered by conductive mesh 117. The front surface of the scintillator is preferably held at positive potential of approximately +3 to +5 kV, such that to avoid any slow electrons in the pass and to improve electron per photon gain. Typical scintillator gain is 10 photons per 1 kV electron energy, i.e. 10 kV electrons are expected to generate approximately 100 photons. Since photons are emitted isotropic, only 30-50% of them will reach the downstream multiplier, which in turn is expected to have approximately 30% quantum efficiency at typical 380-400 nm photon wavelength. As a result, single secondary electron is expected to generate approximately 10 electrons in the PMT photocathode. The PMT gain can be reduced to approximately 1E+5 for detection of individual ions. Sealed PMT, like R9880 by Hamamtsu is capable of providing fast response time of 1-2 ns while having much longer life time in order of 300C at the exit, compared to TOF detectors operating in technical vacuum of the MR-TOF analyzer. The output charge 300C at the total gain of 1E+6 corresponds to 0.0003 C of ion charge. The life time of the detector may be further improved by (a) using smaller PMT gain, say 1E+4 while operating with larger resistor in 1-10 kOhm range which becomes possible due to small capacity of PMTs, and (b) operating yet at even smaller gain, since up to 10 PMT electrons per secondary electron 116 will provide much narrower (factor 2-3) signal height distribution compared to standard TOF detectors. The life time of the detector 111 measured as total charge at the detector entrance is estimated between 0.0003 to 0.001 Coulomb.

To extend the dynamic range of the detector, so as life-time of the detector, preferably, two PMT channels are employed for detecting signals with 10-100 fold difference in sensitivity between PMT1 and PMT2, controlled by solid angle for collecting photons. The low sensitive (say, PMT2) channel may be used for detecting extremely strong signals (1E+2 to 1E+4 ions per ion packet with 3-5 ns duration). Even higher intensity of short ion packets would be prevented by self space charge spatial spreading of intense ion packets in the MR-TOF analyzer. To avoid saturation of the sensitive channel (say PMT1) the PMT-1 preferably comprises an active protecting circuit for automatic limit of charge pulse per dynode stage. Alternatively, PMT with long propagation time and narrow time spread is used (like R6350-10 by Hamamtsu), which allows using an active suppressing circuits sensing charge at upstream dynodes. The improvement in dynamic range is estimated 10-fold and the life time improvement is from 10 to 100-fold, depending on efficiency of active suppressing circuits.

Again referring to FIG. 11, the embodiment 112 is somewhat inferior and more complex compared to embodiment 111, but avoids an additional time spread in the secondary electron path and allows suppressing effects of slow fluorescence of the scintillator. In operation, ion packet 113 hit microchannel plate 115, operating at 100-1000 gain. Secondary electrons 116 are directed onto scintillator 118 covered by mesh 117 for removing electrostatic charging. Preferably electrons are accelerated to 5-10 keV energy while keeping front MCP surface at acceleration potential of the MR-TOF (−4 to −8 kV) and by applying 0 to +5 kV potential $U_{SC}$ to mesh 117. As a result, single ion would be producing 1000 to 10,000 electrons on PMT photocathode. Contrary to strong signals of fast fluorescence, the slow fluorescence would be producing single electrons on the photocathode and such slow signals could be suppressed. Otherwise, detector 112 operates similarly to above described detector 111. For estimating life time of detector 112 let assume MCP gain=100. Then MCP output total charge is below 1E-6 C, and the input total charge is under 0.001 Coulomb.

Both novel detectors provide the longevity up to 0.001 Coulomb of the input charge. Accounting maximal ion flux up to 1E+9 ion/sec (1.6E-10 A) onto MR-TOF detector, the life time of novel detectors is above 6E+6 sec, i.e. 2000 hrs, i.e. 1 year run time. The detectors also allow fast replacement of moderate cost PMT at the atmospheric side. Thus, novel detectors make it possible to operate novel tandems at unprecedented for TOFMS high ion fluxes.

While this specification contains many specifics, these should not be construed as limitations on the scope of the disclosure or of what may be claimed, but rather as descriptions of features specific to particular implementations of the disclosure. Certain features that are described in this specification in the context of separate implementations can also be implemented in combination in a single implementation. Conversely, various features that are described in the context of a single implementation can also be implemented in multiple implementations separately or in any suitable sub-combination. Moreover, although features may be described above as acting in certain combinations and even initially claimed as such, one or more features from a claimed combination can in some cases be excised from the combination, and the claimed combination may be directed to a sub-combination or variation of a sub-combination.

Similarly, while operations are depicted in the drawings in a particular order, this should not be understood as requiring that such operations be performed in the particular order shown or in sequential order, or that all illustrated operations be performed, to achieve desirable results. In certain circumstances, multi-tasking and parallel processing may be advantageous. Moreover, the separation of various system components in the embodiments described above should not be understood as requiring such separation in all embodiments, and it should be understood that the described program components and systems can generally be integrated together in a single software product or packaged into multiple software products.

A number of implementations have been described. Nevertheless, it will be understood that various modifications may be made without departing from the spirit and scope of the disclosure. Accordingly, other implementations are within the scope of the following claims. For example, the actions recited in the claims can be performed in a different order and still achieve desirable results.

What we claim is:

1. An array of identical linearly extended quadrupolar ion traps, each trap comprising:

at least four main electrodes extended in one Z-direction to form a quadrupolar field at least in a centerline region oriented along a Z-axis, wherein the Z-axis is either straight or curved with a radius being much larger compared to distance between said electrodes;

an ion ejection slit in at least one of said main electrodes, wherein said slit is aligned in said Z-direction;

Z-edge electrodes located at Z-edges of said quadrupolar trap to form electrostatic ion plugging at said Z-edges, said Z-edge electrodes being a segment of main electrodes or annular electrodes;

an RF generator providing RF signals of opposite phases to form a quadrupolar RF field at least in the centerline region of main electrodes;

a variable DC supply providing DC signals to at least two rods to form a quadrupolar DC field with a weaker dipolar DC field at least in the centerline region of main electrodes;

a DC, RF or AC supply connected to said Z-edge electrodes to provide axial Z-trapping;

a gas supply or pumping means to provide gas pressure in the range from 1 to 100 mTor, wherein said variable DC supply has means for ramping a quadrupolar potential, thus, causing sequential ion ejection via said slit in the reverse relation to ion m/z, and wherein said array further comprises a wide bore RF channel with DC gradient for ion collection, transfer and spatial confinement past said slits of quadrupolar traps, a dimension of said RF channel being defined by trap sizes and topology and gas pressure.

2. The array as in claim 1, wherein said individual traps are aligned such that to form an ion emission surface being either planar, or at least partially cylindrical or partially spherical for a more efficient ion collection and transfer in said wide bore RF channel.

* * * * *